US010338514B2

(12) United States Patent
Imanaka et al.

(10) Patent No.: US 10,338,514 B2
(45) Date of Patent: Jul. 2, 2019

(54) IMAGE FORMING APPARATUS, DEVELOPER USED THEREBY, AND IMAGE FORMING METHOD

(71) Applicant: KYOCERA Document Solutions Inc., Osaka (JP)

(72) Inventors: Yoshitaka Imanaka, Osaka (JP); Hiroaki Watanabe, Osaka (JP); Masahito Ishino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/517,643

(22) PCT Filed: Oct. 23, 2015

(86) PCT No.: PCT/JP2015/079947

§ 371 (c)(1),
(2) Date: Apr. 7, 2017

(87) PCT Pub. No.: WO2016/068036

PCT Pub. Date: May 6, 2016

(65) Prior Publication Data

US 2017/0329273 A1 Nov. 16, 2017

(30) Foreign Application Priority Data

Oct. 31, 2014 (JP) ..... 2014-222825

(51) Int. Cl.
*G03G 21/00* (2006.01)
*G03G 15/16* (2006.01)
(Continued)

(52) U.S. Cl.
CPC ..... *G03G 21/0011* (2013.01); *G03G 15/161* (2013.01); *G03G 21/0017* (2013.01);
(Continued)

(58) Field of Classification Search
CPC ..... G03G 15/161; G03G 15/095; G03G 21/0011; G03G 21/0064; G03G 21/20
See application file for complete search history.

(56) References Cited

U.S. PATENT DOCUMENTS 6,461,780 B2 * 10/2002 Itami ..... G03G 5/043 430/110.3
6,832,067 B2 * 12/2004 Kubo ..... G03G 21/105 399/350

(Continued)

FOREIGN PATENT DOCUMENTS

JP S63-058481 A 3/1988

*Primary Examiner* — Gregory H Curran
(74) *Attorney, Agent, or Firm* — Studebaker & Brackett PC

(57) ABSTRACT

An image forming apparatus (1) includes an image bearing member (50), a charging section (51), a developing section (52), and a cleaning member (81). The image bearing member (50) contains filler particles (87). The charging section (51) is either in contact with or positioned close to the image bearing member (50) and is configured to electrically charge the image bearing member (50) by generating a proximity discharge between the charging section (51) and the image bearing member (50). The developing section (52) supplies toner to the circumferential surface of the charged image bearing member (50). The cleaning member (81) has a degree of hardness equal to or higher than 65° and a degree of impact resilience equal to or lower than 30%. The cleaning member (81) is brought into pressure contact with the circumferential surface of the image bearing member (50) being rotated, by applying linear pressure equal to or higher than 15 gf/cm.

9 Claims, 9 Drawing Sheets

(51) Int. Cl.
*G03G 15/095* (2006.01)
*G03G 21/20* (2006.01)

(52) U.S. Cl.
CPC ..... *G03G 21/0064* (2013.01); *G03G 15/095* (2013.01); *G03G 21/20* (2013.01); *G03G 2215/0129* (2013.01)

(56) References Cited

U.S. PATENT DOCUMENTS

| | | | | |
|---|---|---|---|---|
| 7,862,968 | B2 * | 1/2011 | Nishina | G03G 5/0507 430/58.05 |
| 2004/0248024 | A1 * | 12/2004 | Suzuki | G03G 5/0614 430/66 |
| 2006/0093931 | A1 * | 5/2006 | Itami | G03G 5/005 430/66 |
| 2008/0069588 | A1 * | 3/2008 | Inaba | G03G 15/011 399/116 |
| 2008/0305416 | A1 * | 12/2008 | Wu | G03G 5/0614 430/58.1 |
| 2013/0330666 | A1 * | 12/2013 | Fukuri | G03G 9/08755 430/109.4 |

* cited by examiner

IMAGE FORMING APPARATUS, DEVELOPER USED THEREBY, AND IMAGE FORMING METHOD

TECHNICAL FIELD

The present invention is related to an image forming apparatus, a developer used thereby, and an image forming method.

BACKGROUND ART

Electrographic image forming apparatuses are configured to form a toner image by supplying toner to the circumferential surface of a photosensitive drum (an image bearing member) and to subsequently transfer the toner image onto a transfer target (e.g., transfer paper or a transfer belt). Further, generally speaking, electrographic image forming apparatuses are configured to, after transferring the toner image, remove any of the toner (which hereinafter may be referred to as "residual toner") remaining on the circumferential surface of the photosensitive drum by using a cleaning blade made of rubber, for example.

However, at the tip end of the cleaning blade (such a part of the cleaning blade that is in contact with the photosensitive drum), the residual toner accumulates as the number of times an image forming process is performed by the image forming apparatus increases. Further, at the tip end of the cleaning blade, paper powder substances (e.g., a lump of cellulose and/or a lump of a filler) occurring from transfer paper may also accumulate. There is a possibility that these accumulating substances may go through the tip end of the cleaning blade after the image forming apparatus is used for a long period of time, if slippery characteristics between the tip end of the cleaning blade and the circumferential surface of the photosensitive drum are unsatisfactory. More specifically, the tip end of the cleaning blade is abraded after the image forming apparatus is used for a long period of time, if the slippery characteristics between the tip end of the cleaning blade and the circumferential surface of the photosensitive drum are unsatisfactory. As a result, it becomes easy for the accumulating substances to go through the tip end of the cleaning blade. Further, the accumulating substances that have gone through the tip end of the cleaning blade may firmly adhere to the circumferential surface of the photosensitive drum. In particular, when an external additive (e.g., resin beads) is added to toner particles (toner base particles), the residual toner (or the external additive) easily adheres firmly to the circumferential surface of the photosensitive drum.

When the accumulating substances firmly adhere to the circumferential surface of the photosensitive drum, dash marks (white dots or black dots) appear in output images because of the firmly-adhering accumulating substances (the residual toner, in particular). More specifically, the dash marks appear in positions corresponding to the locations where the accumulating substances are firmly adhering. Further, the accumulating substances firmly adhering to the circumferential surface of the photosensitive drum tend to chip the tip end of the cleaning blade and to make the cleaning function insufficient. In particular, an external additive used in the toner as a polishing agent has a high possibility of chipping the tip end of the cleaning blade.

Further, a technique has been proposed (see Patent Literature 1, for example) by which the slippery characteristics between the tip end of a cleaning blade and the circumferential surface of a photosensitive drum are improved by roughening the tip end of the cleaning blade. According to this technique, because the slippery characteristics between the tip end of the cleaning blade and the circumferential surface of the photosensitive drum are improved, it is possible to reduce the amount of abrasion of the tip end of the cleaning blade. Accordingly, it becomes more difficult for the accumulating substances to go through the tip end of the cleaning blade.

In addition, another technique is generally known by which the slippery characteristics on the circumferential surface of a photosensitive drum are improved by using a leveling agent. According to this technique, it becomes easier for the tip end of the cleaning blade to slip on the circumferential surface of the photosensitive drum. In other words, the slippery characteristics between the tip end of the cleaning blade and the circumferential surface of the photosensitive drum are improved. Accordingly, it is possible to reduce the amount of abrasion of the tip end of the cleaning blade. It therefore becomes more difficult for the accumulating substances to go through the tip end of the cleaning blade.

CITATION LIST

Patent Literature

[Patent Literature 11]
Japanese Patent Application Laid-Open Publication No. $63-058481

SUMMARY OF INVENTION

Technical Problem

However, even if the tip end of a cleaning blade is roughened, the tip end of the cleaning blade is abraded after the image forming apparatus is used for a long period of time (e.g., after conveying and printing 100,000 sheets of paper). Accordingly, after the image forming apparatus is used for a long period of time, the cleaning blade may be in such a state where accumulating substances easily go through the tip end thereof. Further, even if the slippery characteristics on the circumferential surface of a photosensitive drum are improved by using a leveling agent, after the image forming apparatus is used for a long period of time, the circumferential surface of the photosensitive drum is abraded, and the slippery characteristics on the circumferential surface of the photosensitive drum become degraded. In other words, the slippery characteristics between the tip end of the cleaning blade and the circumferential surface of the photosensitive drum become degraded. Accordingly, the tip end of the cleaning blade may be abraded, and the cleaning blade may be in such a state where accumulating substances easily go through the tip end thereof.

The tip end of a cleaning blade is abraded because the cleaning blade is fixed in a position and because the tip end of the cleaning blade and the circumferential surface of a photosensitive drum constantly rub against each other while the photosensitive drum is rotating. Accordingly, even if the tip end of the cleaning blade is roughened or even if the slippery characteristics on the circumferential surface of the photosensitive drum are improved by using a leveling agent, the cleaning blade may be in such a state where accumulating substances easily go through the tip end thereof after the image forming apparatus is used for a long period of time.

Further, as charging methods for electrically charging a photosensitive drum, contact charging methods such as a roller charging method are generally known. The contact charging methods are charging methods by which a photosensitive drum is electrically charged by a proximity discharge. For example, according to a roller charging method, a discharge is generated in a small gap between a charging roller and a photosensitive drum, so as to electrically charge the photosensitive drum. As explained herein, the contact charging method makes use of the discharge (the proximity discharge) generated in the small gap. Accordingly, the amount of ozone generated thereby is small.

However, according to charging methods making use of a proximity discharge, ions generated by the discharge collide with the circumferential surface of the photosensitive drum while having a large amount of energy. For this reason, when the photoconductor is an organic photoconductor, binder resin of the photoconductor easily becomes degraded. When the binder resin of the photoconductor becomes degraded, the friction coefficient of the circumferential surface of the photosensitive drum increases. When the friction coefficient increases, the slippery characteristics become degraded. Accordingly, even if the tip end of the cleaning blade is roughened, the cleaning blade may go into such a state where accumulating substances easily go through the tip end thereof, as a result of an increase in the friction coefficient of the circumferential surface of the photosensitive drum caused by the proximity discharge. Similarly, even if the slippery characteristics on the circumferential surface of the photosensitive drum are improved by using a leveling agent, the cleaning blade may go into such a state where accumulating substances easily go through the tip end thereof, as a result of an increase in the friction coefficient of the circumferential surface of the photosensitive drum caused by the proximity discharge.

For these reasons, a technique is in demand by which it is possible to prevent a cleaning blade (a cleaning member) from going into a state where accumulating substances easily go through the tip end thereof, even after the image forming apparatus is used for a long period of time or even when the photosensitive drum is electrically charged by generating a proximity discharge.

In view of the problems described above, an object of the present invention is to provide an image forming apparatus in which it is difficult for accumulating substances such as residual toner to go through the tip end of a cleaning member, a developer used in the image forming apparatus, and an image forming method.

Solution to Problem

An image forming apparatus according to the present invention includes an image bearing member, a charging section, a developing section, and a cleaning member. The image bearing member contains filler particles. The charging section is either in contact with or positioned close to the image bearing member and is configured to electrically charge the image bearing member by generating a proximity discharge between the charging section and the image bearing member. The developing section supplies toner to the circumferential surface of the charged image bearing member. The cleaning member has a degree of hardness equal to or higher than 65° and a degree of impact resilience equal to or lower than 30%. The cleaning member is brought into pressure contact with the circumferential surface of the image bearing member being rotated, by applying linear pressure equal to or higher than 15 gf/cm.

A developer according to the present invention is used in the image forming apparatus described above. The developer includes: a plurality of toner base particles and an external additive adhering to surfaces of the toner base particles. The external additive includes a polishing agent and resin beads.

A image forming method according to the present invention includes: electrically charging an image bearing member; forming a toner image on the circumferential surface of the image bearing member by supplying toner to the circumferential surface of the charged image bearing member; transferring the toner image from the circumferential surface of the image bearing member onto a transfer target; and removing any of the toner remaining on the circumferential surface of the image bearing member by bringing a cleaning member into pressure contact with the circumferential surface of the image bearing member being rotated, by applying linear pressure equal to or higher than 15 gf/cm, the cleaning member having a degree of hardness equal to or higher than 65° and a degree of impact resilience equal to or lower than 30%.

Advantageous Effects of Invention

According to the present invention, it is difficult for the accumulating substances such as residual toner to go through the tip end of the cleaning member.

DESCRIPTION OF EMBODIMENTS

Figure 1:
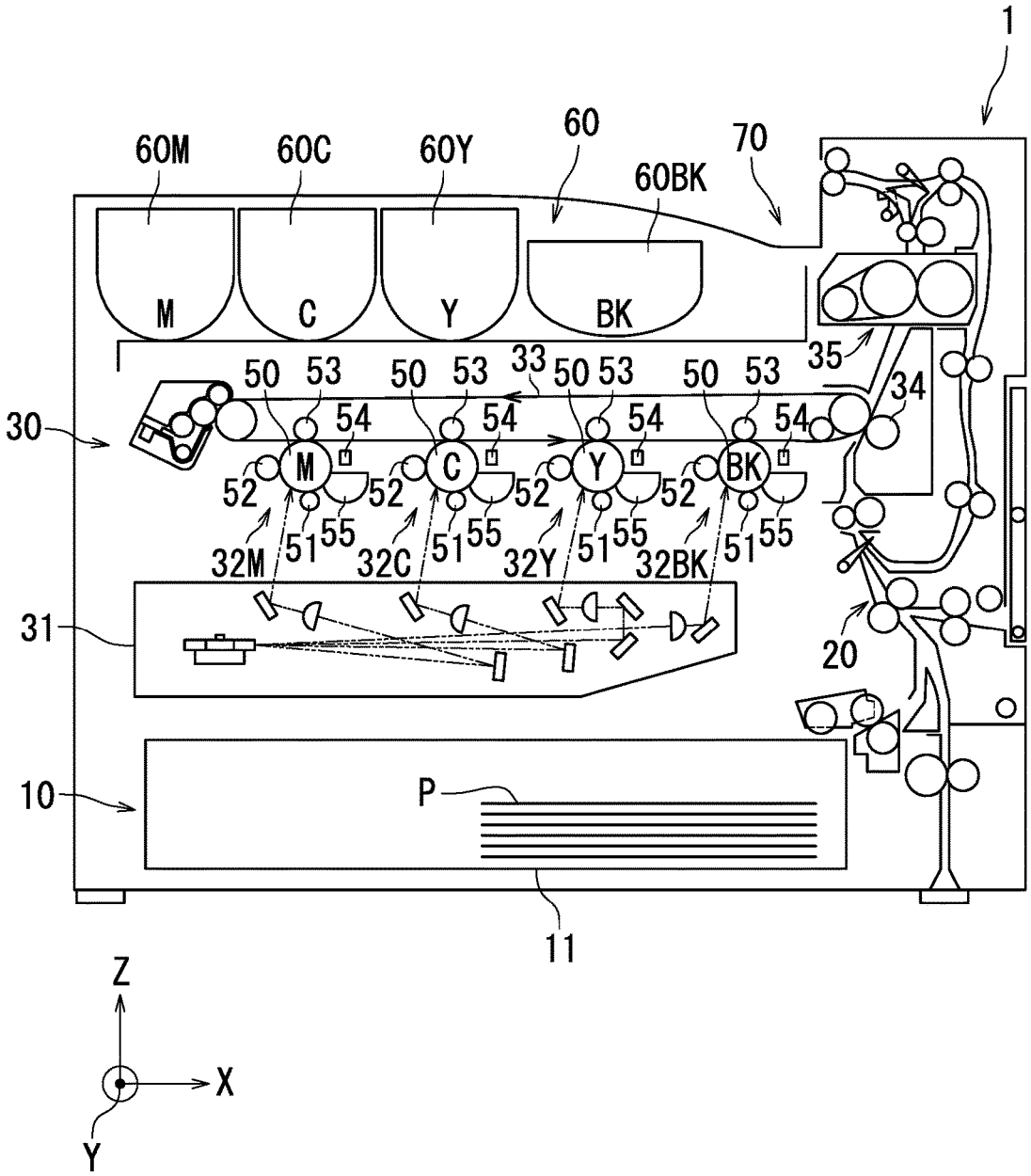
FIG. 1 is a cross-sectional view of an image forming apparatus according to an embodiment of the present invention.

Embodiments of the present invention will be explained below with reference to the accompanying drawings. Some of the elements in the drawings that are the same as or corresponding to each other will be referred to by using the same reference characters, and explanations thereof will not be repeated. The drawings schematically illustrate configurations primarily focusing on the constituent elements therein, in order to facilitate understanding thereof. Consequently, the shapes and the like of the illustrated constituent elements may be different from those in actuality, due to convenience in the preparation of the drawings.

An image forming apparatus 1 according to an embodiment will be explained with reference to FIG. 1. FIG. 1 is a cross-sectional view of the image forming apparatus 1. In FIG. 1, the X-axis, the Y-axis, and the Z-axis are orthogonal to one another.

In the present embodiment, the image forming apparatus 1 is a full-color printer. The image forming apparatus 1 includes a forwarding section 10, a conveyance section 20, an image forming section 30, a toner supplying section 60, and an exit section 70. The forwarding section 10 includes a cassette 11 capable of storing therein a plurality of sheets P. The forwarding section 10 forwards each of the sheets P from the cassette 11 to the conveyance section 20. Each of the sheets P may be, for example, a sheet of paper or a sheet of synthetic resin.

The conveyance section 20 conveys each of the sheets P to the image forming section 30. The image forming section 30 includes an exposure unit 31, an M unit 32M, a C unit 32C, a Y unit 32Y, a BK unit 32BK, an intermediate transfer belt 33, a secondary transfer roller 34, and a fusing unit 35.

The exposure unit 31 irradiates each of the units from the M unit 32M to the BK unit 32BK with light based on image data, so as to form an electrostatic latent image on each of the units from the M unit 32M to the BK unit 32BK. The M unit 32M forms a toner image in the color of magenta on the basis of the electrostatic latent image. The C unit 32C forms a toner image in the color of cyan on the basis of the electrostatic latent image. The Y unit 32Y forms a toner image in the color of yellow on the basis of the electrostatic latent image. The BK unit 32BK forms a toner image in the color of black on the basis of the electrostatic latent image. The toner images in the four colors are transferred onto the external surface of the intermediate transfer belt 33 so as to be superimposed on top of one another. As a result, a color toner image is formed on the external surface of the intermediate transfer belt 33. The secondary transfer roller 34 transfers the color toner image formed on the external surface of the intermediate transfer belt 33 onto one of the sheets P. The fusing unit 35 applies heat and pressure to the sheet P so as to fuse the color toner image on the sheet P. After that, the sheet P is put out by the exit section 70.

Each of the units, i.e., the M unit 32M, the C unit 32C, the Y unit 32Y, and the BK unit 32BK, includes a photosensitive drum 50 (an image bearing member), a charging roller 51 (a charging section), a developing roller 52 (a developing section), a primary transfer roller 53, a charge removing lamp 54, and a cleaner 55.

The photosensitive drum 50 rotates on a rotation axis. The photosensitive drum 50 may be, for example, a positively-chargeable Organic Photoconductor (OPC) drum. Alternatively, the photosensitive drum 50 may be a negatively-chargeable OPC drum. When the photosensitive drum 50 is a positively- or negatively-chargeable OPC drum, the photosensitive layer of the OPC drum is shaved off as the number of times an image forming process is performed by the image forming apparatus 1 increases. The life of the OPC drum expires at a stage when the photosensitive layer has been shaved off, for example, by approximately 20 μm to 25 μm. In the present embodiment, the photosensitive drum 50 is an OPC drum. The photosensitive layer of the photosensitive drum 50 may be a single-layer-type photosensitive layer or a multi-layer-type photosensitive layer. However, because positively-chargeable single-layer-type organic photoconductor drums have excellent abrasion-resistant characteristics, it is desirable to use a positively-chargeable single-layer-type organic photoconductor drum.

The charging roller 51 electrically charges the circumferential surface of the photosensitive drum 50 (the surface of the photosensitive layer). More specifically, the charging roller 51 comes into contact with the circumferential surface of the photosensitive drum 50 and applies a charging bias to the circumferential surface of the photosensitive drum 50. In other words, a charging method used for electrically charging the photosensitive drum 50 is a roller charging method (an example of the contact charging methods). The charging roller 51 electrically charges the photosensitive drum 50 by generating a proximity discharge between the charging roller 51 and the circumferential surface of the photosensitive drum 50. In the present embodiment, the charging bias is a direct-current voltage. However, the charging bias may be a voltage obtained by superimposing an alternating-current voltage onto a direct-current voltage. An electrostatic latent image is formed by the exposure unit 31 on the circumferential surface of the photosensitive drum 50 (the surface of the photosensitive layer).

The developing roller 52 supplies toner to the circumferential surface of the photosensitive drum 50. Accordingly, the toner adheres to the circumferential surface of the photosensitive drum 50 according to the electrostatic latent image, so that the electrostatic latent image is developed. As a result, a toner image is formed on the circumferential surface of the photosensitive drum 50.

The primary transfer roller 53 transfers the toner image formed on the circumferential surface of the photosensitive drum 50 onto the external surface of the intermediate transfer belt 33. The charge removing lamp 54 removes residual charges on the circumferential surface of the photosensitive drum 50 (the surface of the photosensitive layer).

The cleaner 55 removes any of the toner remaining on the circumferential surface of the photosensitive drum 50 (residual toner). Further, when powder substances (e.g., a lump of cellulose and/or a lump of filler) occurring from the sheets P adhere to the circumferential surface of the photosensitive drum 50, the cleaner 55 is capable of removing the adhering powder substances. In the following sections, any unwanted matters such as the residual toner adhering to the circumferential surface of the photosensitive drum 50 may collectively be referred to as adhering substances.

The toner supplying section 60 includes four cartridges, namely, a cartridge 60M, a cartridge 60C, a cartridge 60Y, and a cartridge 60BK. The cartridge 60M contains toner in the color of magenta. The cartridge 60C contains toner in the color of cyan. The cartridge 60Y contains toner in the color of yellow. The cartridge 60BK contains toner in the color of black. The cartridge 60M, the cartridge 60C, the cartridge 60Y, and the cartridge 60BK supply the toner (a developer) contained therein to the developing rollers 52 of the M unit 32M, the C unit 32C, the Y unit 32Y, and the BK unit 32BK, respectively.

Figure 2:
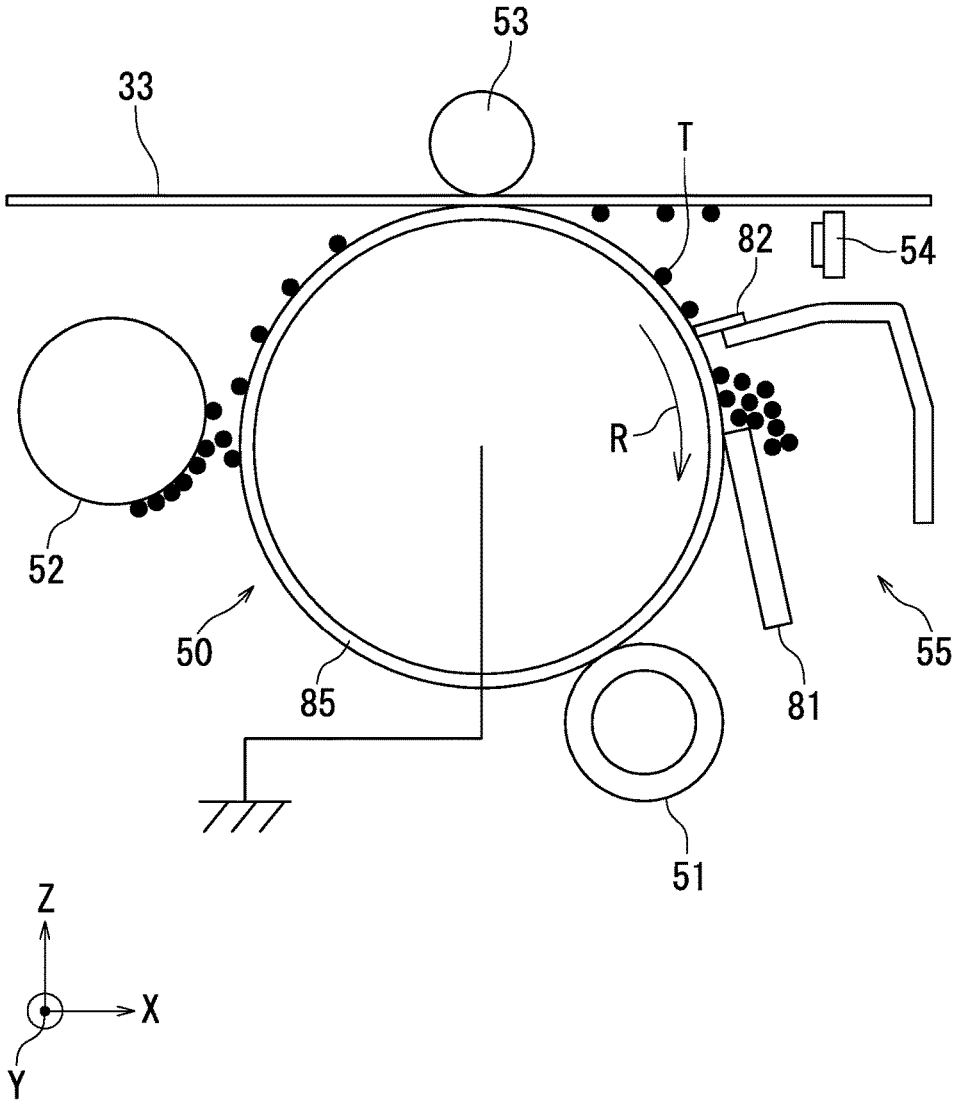
FIG. 2 is a drawing illustrating a configuration of a cleaner included in the image forming apparatus according to the embodiment of the present invention.

Next, the cleaner 55 will be explained, with reference to FIG. 2. FIG. 2 is a drawing illustrating a configuration of the cleaner 55. The cleaner 55 includes a cleaning blade 81 (a cleaning member) and a toner sealer 82.

The cleaning blade 81 may be made of rubber, for example. The cleaning blade 81 is in pressure contact with the circumferential surface of the photosensitive drum 50 on a downstream side of the primary transfer roller 53 in terms of the rotation direction R of the photosensitive drum 50. More specifically, the tip end of the cleaning blade 81 is in pressure contact with the circumferential surface of the photosensitive drum 50. At the contact point between the tip end of the cleaning blade 81 and the circumferential surface of the photosensitive drum 50, the direction from the basal end to the tip end of the cleaning blade 81 is opposite of the rotation direction R and intersects the rotation direction R. With this configuration, the cleaning blade 81 removes the adhering substances (e.g., residual toner T) adhering to the circumferential surface of the photosensitive drum 50.

In the present embodiment, the linear pressure applied to the circumferential surface of the photosensitive drum 50 from the tip end of the cleaning blade 81 in the direction toward the center of the photosensitive drum 50 is set at a predetermined value. More specifically, the linear pressure is set to a value larger than 15 gf/cm at an initial stage. In the following sections, the linear pressure applied to the circumferential surface of the photosensitive drum 50 from the tip end of the cleaning blade 81 in the direction toward the center of the photosensitive drum 50 will be referred to as the linear pressure applied from the cleaning blade 81 in the direction toward the drum center. The higher the linear pressure applied from the cleaning blade 81 in the direction toward the drum center is, the easier it is to remove the adhering substances from the circumferential surface of the photosensitive drum 50. Further, the adhering substances that have been removed from the circumferential surface of the photosensitive drum 50 accumulate at the tip end of the cleaning blade 81. The higher the linear pressure applied from the cleaning blade 81 in the direction toward the drum center is, the higher is the effect of the cleaning blade 81 in blocking and holding the accumulating substances that are accumulating at the tip end of the cleaning blade 81, which means that, the more difficult it is for the accumulating substances to go through the tip end of the cleaning blade 81.

However, the higher the linear pressure applied from the cleaning blade 81 in the direction toward the drum center is, the more easily the photosensitive drum 50 is shaved off, which shortens the life span of the photosensitive drum 50. Accordingly, the linear pressure applied from the cleaning blade 81 in the direction toward the drum center is adjusted while the life span of the photosensitive drum 50 is taken into account.

A material having a relatively high degree of hardness is selected as the material for the cleaning blade 81. The reason is that, when the hardness of the cleaning blade 81 is too low, the cleaning blade 81 may not be able to scrape the adhering substances adhering to the circumferential surface of the photosensitive drum 50. In other words, the higher the degree of hardness of the cleaning blade 81 is, the easier it is to remove the adhering substances from the circumferential surface of the photosensitive drum 50. Further, the higher the degree of hardness of the cleaning blade 81 is, the higher is the effect of the cleaning blade 81 in blocking and holding the accumulating substances that are accumulating at the tip end of the cleaning blade 81. More specifically, the degree of hardness of the cleaning blade 81 is, preferably, equal to or higher than 65°, and even more preferably, equal to or higher than 70°, on the JIS-A hardness scale.

However, when the hardness of the cleaning blade 81 is too high, the circumferential surface of the photosensitive drum 50 may be scratched, or squeaking noise (i.e., friction noise between the rotating photosensitive drum 50 and the cleaning blade 81) may be caused. For this reason, the degree of hardness of the cleaning blade 81 is, preferably, equal to or lower than 85°, and even more preferably, equal to or lower than 80°, on the JIS-A hardness scale.

Further, a material having a relatively low degree of impact resilience is selected as the material for the cleaning blade 81. The lower the degree of impact resilience of the cleaning blade 81 is, the smaller is the micro-motion (a so-called "stick slip phenomenon") occurring at the tip end of the cleaning blade 81. As a result, it becomes more difficult for the adhering substances adhering to the circumferential surface of the photosensitive drum 50 and the accumulating substances accumulating at the tip end of the cleaning blade 81 to go through the tip end of the cleaning blade 81. More specifically, the impact resilience of the cleaning blade 81 is, preferably, equal to or lower than 35%, and even more preferably, equal to or lower than 30%.

However, when the impact resilience of the cleaning blade 81 is too low, the tip end of the cleaning blade 81 is easily abraded by the friction occurring between the tip end of the cleaning blade 81 and the circumferential surface of the photosensitive drum 50, especially in a low-temperature environment. As a result, the cleaning function thereof may become insufficient (going through of the adhering substances and/or the accumulating substances). For this reason, the impact resilience of the cleaning blade 81 is, preferably, equal to or higher than 20%.

The toner sealer 82 is in contact with the circumferential surface of the photosensitive drum 50 in a position between the primary transfer roller 53 and the cleaning blade 81. The toner sealer 82 prevents the adhering substances (e.g., the residual toner T) removed and collected by the cleaning blade 81 from scattering.

Figure 3A:
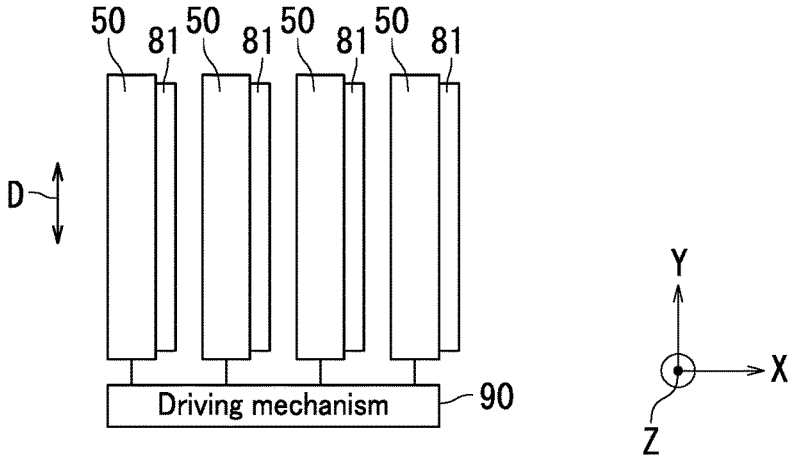
FIG. 3A is a plan view illustrating a photosensitive drum, a cleaning blade, and a driving mechanism included in the image forming apparatus according to the embodiment of the present invention.

Next, the photosensitive drum 50 and peripherals thereof will be explained, with reference to FIGS. 3A to 3D. FIG. 3A is a plan view illustrating the photosensitive drum 50, the cleaning blade 81, and a driving mechanism 90. The photosensitive drum 50 has a circular cylindrical shape extending along a rotation axis direction D of the photosensitive drum 50. The cleaning blade 81 has a plate-like shape extending along the rotation axis direction D.

The image forming apparatus 1 further includes the driving mechanism 90. The driving mechanism 90 causes the photosensitive drum 50 and the cleaning blade 81 to reciprocate (to swing) relative to each other along the rotation axis direction D. However, a mechanism that causes the photosensitive drum 50 and the cleaning blade 81 to reciprocate at the same time may require a complicated configuration. Accordingly, it is preferable to cause one selected from between the photosensitive drum 50 and the cleaning blade 81 to reciprocate. Further, a mechanism that causes the cleaning blade 81 to reciprocate may require a more complicated configuration than a mechanism that causes the photosensitive drum 50 to reciprocate does. Accordingly, it is preferable to cause the photosensitive drum 50 to reciprocate.

In the present embodiment, the driving mechanism 90 causes the photosensitive drum 50 to reciprocate (thrust) periodically. For example, the driving mechanism 90 includes a driving source such as a motor, a gear train, a plurality of cams, and a plurality of elastic members. The cleaning blade 81 may be fixed to a housing of the image forming apparatus 1, for example.

As explained above with reference to FIG. 3A, according to the present embodiment, the photosensitive drum 50 is caused to reciprocate relative to the cleaning blade 81, along the rotation axis direction D. With this arrangement, because the accumulating substances that are accumulating at the tip end of the cleaning blade 81 move in the rotation axis direction D, it becomes more difficult for the accumulating substances to be distributed unevenly. As a result, it is possible to suppress uneven abrasion that may be caused on the circumferential surface of the photosensitive drum 50 by an uneven distribution of the accumulating substances. Accordingly, the friction coefficient of the circumferential surface of the photosensitive drum 50 is kept at a certain level along the rotation axis direction D. Consequently, it is possible to maintain slippery characteristics on the circumferential surface of the photosensitive drum 50, and it is therefore difficult for the adhering substances and the accumulating substances to go through the tip end of the cleaning blade 81. Further, if the circumferential surface of the photosensitive drum 50 was unevenly abraded, it would become easier for the adhering substances and the accumulating substances to go through the tip end of the cleaning blade 81 in a section that is unevenly abraded. In contrast, according to the present embodiment, because uneven abrasion on the circumferential surface of the photosensitive drum 50 is suppressed, it is more difficult for the adhering substances and the accumulating substances to go through the tip end of the cleaning blade 81.

Further, according to the present embodiment, because the photosensitive drum 50 is caused to reciprocate, it is possible to cause the photosensitive drum 50 and the cleaning blade 81 to reciprocate relative to each other along the rotation axis direction D, by using the simple configuration. Further, in comparison to the situation where the cleaning blade 81 is caused to reciprocate, the driving force required by the reciprocating movement is more easily obtained, and in addition, it is also possible to prevent the toner from leaking from the two ends of the cleaning blade 81.

Further, the inventors of the present application conducted intensive research on a relationship among the linear pressure applied from the cleaning blade 81 in the direction toward the drum center, the reciprocating movement of the photosensitive drum 50 and the cleaning blade 81 relative to each other, and occurrence of dash marks. It has been discovered that, the longer the moving distance in one turn (in one rotation) of the photosensitive drum 50 (hereinafter, "thrust speed") is, the better the occurrence of dash marks is prevented by increasing the linear pressure applied from the cleaning blade 81 in the direction toward the drum center, the moving distance denoting the distance by which the photosensitive drum 50 and the cleaning blade 81 move relative to each other.

More specifically, the cleaning blade 81 achieves the cleaning capability thereof by being pressed against the photosensitive drum 50. The pressing force for the cleaning blade 81 is made up of a static pressing force and a dynamic pressing force. The static pressing force is an initial setting value of a pressure contact force (including the linear pressure) to bring the cleaning blade 81 into pressure contact with the photosensitive drum 50. The dynamic pressing force is a pressing force generated as a result of the cleaning blade 81 being pulled together in the rotation direction R of the photosensitive drum 50. The inventors of the present application discovered that it is possible to reduce the dynamic pressing force by causing the photosensitive drum 50 and the cleaning blade 81 to reciprocate relative to each other in the rotation axis direction D of the photosensitive drum 50. The dynamic pressing force is reduced because a force in the rotation axis direction D is applied to the tip end of the cleaning blade 81. Further, the inventors of the present application conducted further research on the initial setting value of the pressure contact force that is necessary in order to keep the cleaning capability from being degraded. In other words, the inventors conducted further research on the initial setting value of the pressure contact force that is able to offset the decrease in the dynamic pressing force.

As a result, when the thrust speed is higher than 0 [μm/one turn of the drum] and is equal to or lower than 100 [μm/one turn of the drum], it has been discovered that it is possible to prevent the occurrence of dash marks by arranging the linear pressure (the initial setting value of the pressure contact force) applied from the cleaning blade 81 in the direction toward the drum center to be equal to or larger than a value selected according to the thrust speed from a range of a lower limit value L expressed in Expression (1) shown below:

$$15\ \text{gf/cm} < L \leq 45\ \text{gf/cm} \quad (1)$$

In the present embodiment, the linear pressure applied from the cleaning blade 81 in the direction toward the drum center is arranged to be equal to or larger than the value selected according to the thrust speed from the range of the lower limit value L expressed in Expression (1). With this arrangement, it is possible to prevent the occurrence of dash marks. The term "dash marks" denotes white or black dots that may appear in output images. Dash marks are caused when the adhering substances adhering to the circumferential surface of the photosensitive drum 50 and/or the accumulating substances accumulating at the tip end of the cleaning blade 81 firmly adhere to the circumferential surface of the photosensitive drum 50. Accordingly, when the occurrence of dash marks is prevented, it means that it is more difficult for the residual toner T and the like to go through the tip end of the cleaning blade 81.

Further, the inventors of the present application conducted intensive research on a relationship among the linear pressure applied from the cleaning blade 81 in the direction toward the drum center, the reciprocating movements of the photosensitive drum 50 and the cleaning blade 81 relative to each other, and the life span of the photosensitive drum 50 (shaved-off amounts of the photosensitive layer). Further, the inventors have discovered that the higher the linear pressure applied from the cleaning blade 81 in the direction toward the drum center is, the shorter the life span of the photosensitive drum 50 becomes. In contrast, it has also been discovered that, even when the linear pressure applied from the cleaning blade 81 in the direction toward the drum center is increased, the higher the thrust speed is, the better the shortening of the life span of the photosensitive drum 50 is prevented (the longer period of time the photosensitive drum 50 is usable). In other words, even when the linear pressure applied from the cleaning blade 81 in the direction toward the drum center is increased, the higher the thrust speed is, the longer period of time the photosensitive drum 50 is usable. More specifically, the inventors have discovered that, when the thrust speed is higher than 0 [μm/one turn of the drum] and is equal to or lower than 100 [μm/one turn of the drum], it is possible to keep the shaved-off amount of the photosensitive layer of the photosensitive drum 50 equal to or smaller than 25 μm even after printing, for example, 100,000 sheets of transfer paper without changing the photosensitive drum 50, by arranging the linear pressure applied from the cleaning blade 81 in the direction toward the drum center to be equal to or smaller than a value selected according to the thrust speed from a range of an upper limit value U1 expressed in Expression (2) shown below:

$$45\ \text{gf/cm} < U1 < 92\ \text{gf/cm} \quad (2)$$

In the present embodiment, the linear pressure applied from the cleaning blade 81 in the direction toward the drum center is arranged to be equal to or smaller than the value selected according to the thrust speed from the range of the upper limit value U1 expressed in Expression (2). With this arrangement, it is possible to extend the life span of the photosensitive drum 50.

Figure 3B:
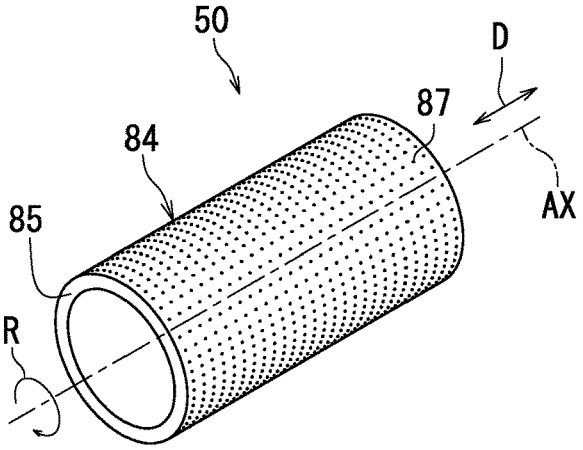
FIG. 3B is a perspective view illustrating the photosensitive drum according to the embodiment of the present invention.

FIG. 3B is a perspective view illustrating the photosensitive drum 50. The photosensitive drum 50 rotates on a rotation axis AX in the rotation direction R. The rotation axis direction D is the direction in which the rotation axis AX extends. The photosensitive drum 50 includes a photosensitive layer 85. The photosensitive layer 85 contains a charge generating agent, a charge transporting agent, and binder resin. The photosensitive layer 85 further contains a plurality of filler particles 87. In the present embodiment, the binder resin is a polycarbonate resin. By using a polycarbonate resin as the binder resin, it is possible to prevent the photosensitive layer 85 from being abraded, even when the pressure contact force applied from the tip end of the cleaning blade 81 to the photosensitive layer 85 is increased. It is therefore possible to extend the life span of the photosensitive drum 50.

The photosensitive layer 85 has a circumferential surface 84. The circumferential surface 84 of the photosensitive layer 85 structures the circumferential surface of the photosensitive drum 50. A protection layer may be formed on the circumferential surface of the photosensitive layer 85. In that situation, the circumferential surface of the protection layer structures the circumferential surface of the photosensitive drum 50. Further, it is preferable to configure the protection layer to contain a plurality of filler particles 87. Alternatively, it is acceptable to configure only the protection layer to contain a plurality of filler particles 87.

The plurality of filler particles 87 roughen the circumferential surface 84 of the photosensitive layer 85. As a result, the contact area between the circumferential surface of the photosensitive drum 50 (the circumferential surface 84 of the photosensitive layer 85) and the tip end of the cleaning blade 81 is reduced. Accordingly, the slippery characteristics between the circumferential surface of the photosensitive drum 50 and the tip end of the cleaning blade 81 are improved. As a result, it becomes more difficult for the adhering substances adhering to the circumferential surface of the photosensitive drum 50 and the accumulating substances accumulating at the tip end of the cleaning blade 81 to go through the tip end of the cleaning blade 81.

Figure 3C:
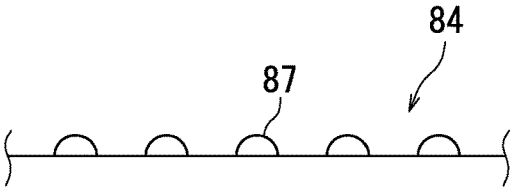
FIG. 3C is an enlarged view of the circumferential surface of the photosensitive drum according to the embodiment of the present invention.

FIG. 3C is an enlarged view of the circumferential surface of the photosensitive drum 50. When the photosensitive layer 85 is shaved off as the number of times the image forming process is performed by the image forming apparatus 1 increases, the filler particles 87 start protruding from the circumferential surface 84 of the photosensitive layer 85. The plurality of filler particles 87 protruding from the circumferential surface 84 of the photosensitive layer 85 may be distributed evenly. Accordingly, the circumferential surface 84 of the photosensitive layer 85 in an initial state may be roughened evenly by the plurality of filler particles 87. It is preferable if the friction coefficient of the filler particles 87 is smaller than the friction coefficient of the binder resin contained in the photosensitive layer 85. Further, it is preferable if the filler particles 87 have a degree of hardness higher than that of the binder resin contained in the photosensitive layer 85. The filler particles 87 may be inorganic particles. For example, it is possible to use silicone filler as the filler particles having a friction coefficient smaller than that of the binder resin and having a degree of hardness higher than that of the binder resin.

As explained above with reference to FIG. 3C, according to the present embodiment, when the photosensitive layer 85 is shaved off as the number of times the image forming process is performed by the image forming apparatus 1 increases, the plurality of filler particles 87 protrude from the photosensitive layer 85. As a result, the tip end of the cleaning blade 81 starts being in contact with the plurality of filler particles 87. Accordingly, even when the photosensitive layer 85 is shaved off as the number of times the image forming process is performed by the image forming apparatus 1 increases, it is possible to reduce the contact area between the circumferential surface of the photosensitive drum 50 (the circumferential surface 84 of the photosensitive layer 85) and the tip end of the cleaning blade 81. As a result, it is possible to improve the slippery characteristics between the circumferential surface of the photosensitive drum 50 and the tip end of the cleaning blade 81. Consequently, it is more difficult for the adhering substances adhering to the circumferential surface of the photosensitive drum 50 and the accumulating substances accumulating at the tip end of the cleaning blade 81 to go through the tip end of the cleaning blade 81.

Further, in the present embodiment, the friction coefficient of the filler particles 87 is smaller than the friction coefficient of the binder resin contained in the photosensitive layer 85. Accordingly, the tip end of the cleaning blade 81 easily slips on the circumferential surface 84 of the photosensitive layer 85. In other words, it is possible to improve the slippery characteristics between the circumferential surface of the photosensitive drum 50 and the tip end of the cleaning blade 81. Consequently, it is more difficult for the adhering substances adhering to the circumferential surface of the photosensitive drum 50 and the accumulating substances accumulating at the tip end of the cleaning blade 81 to go through the tip end of the cleaning blade 81.

Further, the larger the total area of the filler particles 87 protruding from the photosensitive layer 85 is, the more easily the tip end of the cleaning blade 81 slips on the circumferential surface 84 of the photosensitive layer 85, because the friction coefficient of the circumferential surface 84 of the photosensitive layer 85 becomes closer to the friction coefficient of the filler particles 87.

Further, in the present embodiment, the plurality of filler particles 87 protruding from the photosensitive layer 85 are evenly distributed. Accordingly, in any position on the circumferential surface 84 of the photosensitive layer 85, it is possible to arrange the tip end of the cleaning blade 81 to easily slip on the circumferential surface 84 of the photosensitive layer 85.

Further, in the present embodiment, the filler particles 87 are harder than the binder resin contained in the photosensitive layer 85. Accordingly, even when the photosensitive layer 85 is abraded, it is difficult for the filler particles 87 to be abraded. Consequently, the filler particles 87 easily protrude from the circumferential surface 84 of the photosensitive layer 85. Further, by using the filler particles 87, it is possible to prevent the photosensitive layer 85 from being abraded.

Figure 3D:
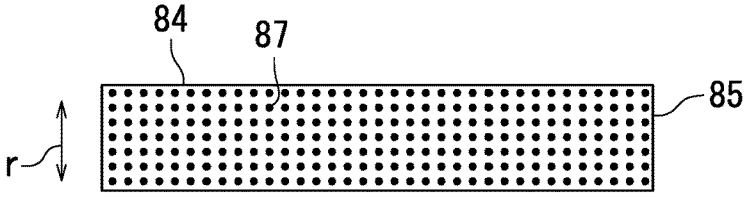
FIG. 3D is a cross-sectional view illustrating a photosensitive layer of the photosensitive drum according to the embodiment of the present invention.

FIG. 3D is a cross-sectional view illustrating the photosensitive layer 85 of the photosensitive drum 50. The plurality of filler particles 87 may be distributed evenly on the inside of the photosensitive layer 85. In other words, the plurality of filler particles 87 may be distributed evenly in the radial direction r of the photosensitive drum 50.

In the present embodiment, the plurality of filler particles 87 are distributed evenly on the inside of the photosensitive layer 85. Accordingly, even when the photosensitive layer 85 is abraded, the plurality of filler particles 87 protrude from the photosensitive layer 85 at all times. As a result, it is possible to keep, for a long period of time, the circumferential surface 84 of the photosensitive layer 85 in such a state in which the tip end of the cleaning blade 81 easily slips thereon. Further, when a multi-layer-type photosensitive layer is used as the photosensitive layer, for example, it is also acceptable to arrange only a charge transporting layer to contain the filler particles 87. Further, when the multi-layer-type photosensitive layer includes a protection layer, it is acceptable to arrange only the protection layer to contain the filler particles 87 or to arrange only the protection layer and a charge transporting layer to contain the filler particles 87.

Next, the developer contained in the cartridges 60M to 60BK illustrated in FIG. 1 will be explained. The developer may be a one-component developer or a two-component developer. The developer includes toner. When the developer is a two-component developer, the developer includes a carrier in addition to the toner.

The toner is a powder structured with a plurality of toner particles (a large number of toner particles). The toner particles may contain toner base particles and an external additive. The external additive adheres to the surfaces of the toner base particles. The toner base particles may contain toner-base-particle binder resin and internal additives (e.g., a release agent and a coloring agent). Note that if unnecessary, the toner particles do not necessarily have to contain the external additive. In this situation, the toner base particles correspond to the toner particles. Further, if necessary, the toner base particles may contain, as internal additives, a charge controlling agent and/or magnetic powder. Further, if unnecessary, the toner base particles do not necessarily have to contain the internal additives. Further, the toner may be capsule toner. It is possible to manufacture the capsule toner by forming a shell layer on the surfaces of the toner base particles.

For example, the toner may be a low-temperature fusing toner that is able to save energy by realizing a fusing process at a low-temperature. The softening point (Tm) of the toner-main-particle binder resin contained in the low-temperature fusing toner may be, for example, 100° C. or lower. The glass transition point (Tg) of the toner-main-particle binder resin contained in the low-temperature fusing toner may be, for example, 55° C. or lower. Further, the lowest fusing temperature of the low-temperature fusing toner is, for example, 160° C. or lower, when being measured by using the method described below. More specifically, the lowest fusing temperature of the low-temperature fusing toner is, for example, in the range from 120° C. to 150° C. inclusive, when being measured by using the method described below.

The method for measuring the lowest fusing temperature will be explained. A two-component developer is prepared by mixing 100 parts by mass of a developer-specific carrier (a carrier for FS-C5250DN) with 5 parts by mass of a sample (the toner) for thirty minutes by using a ball mill. As an evaluation apparatus, a color printer including a fusing device that applies heat and pressure while using a roller-roller method is used. (The evaluation apparatus is obtained by modifying "FS-C5250DN" manufactured by KYOCERA Document Solutions Inc. in such a manner that the fusing temperature is changeable.) The two-component developer prepared as described above is input to the developing device of the evaluation apparatus, so as to form an image by using the evaluation apparatus and to evaluate the low-temperature fusibility of the sample (the toner).

To evaluate the low-temperature fusibility of the sample (the toner), a solid image having the size of 25 mm by 25 mm is formed by using the abovementioned evaluation apparatus on a sheet of paper weighing 90 g/m$^2$ (A4-sized evaluation paper) so as to satisfy the condition where the toner coat amount is 1.0 mg/cm$^2$. Subsequently, the paper on which the image has been formed is put through the fusing device. More specifically, by gradually increasing the fusing temperature of the fusing device, the lowest temperature (the lowest fusing temperature) at which it is possible to fuse the toner (the solid image) onto the paper is measured.

Whether it was possible to fuse the toner or not during the process of measuring the lowest fusing temperature is checked by performing a fold-and-rub test as explained below. To perform the fold-and-rub test, at first, the sheet of paper is folded in half with the image-formed side facing inside. After that, the folded edge is rubbed in five reciprocating motions, by using a 1-kilogram weight covered by cloth. Subsequently, the paper is unfolded so that the folded part of the paper (the part where the solid image was formed) can be observed. The length by which the toner came off the paper (hereinafter, "coming-off length") in the folded part is measured. The lowest value among the fusing temperatures that exhibited a coming-off length of 1 mm or shorter is determined to be the lowest fusing temperature.

Such low-temperature fusing toner easily adheres to the circumferential surface of a photosensitive drum. Accordingly, when low-temperature fusing toner is used, residual toner adheres to the circumferential surface of a photosensitive drum even more easily when the dynamic pressing force of a cleaning blade during the reciprocating movements becomes lower.

In contrast, according to the present embodiment, the linear pressure (the initial setting value) applied from the cleaning blade 81 in the direction toward the drum center is arranged to be equal to or larger than the value selected according to the thrust speed from the range of the lower limit value L expressed in Expression (1) shown above. With this arrangement, even when low-temperature fusing toner is used, it is difficult for the residual toner T to go through the tip end of the cleaning blade 81. In other words, it is difficult for the residual toner T to firmly adhere to the circumferential surface of the photosensitive drum 50.

Further, according to the present embodiment, the external additive of the toner may contain a polishing agent. For example, the polishing agent may be an inorganic polishing agent to which a conductive treatment has been applied. The polishing agent is, preferably, at least one selected from a group consisting of inorganic polishing agents including titanium oxide to which a conductive treatment has been applied and inorganic polishing agents including strontium titanate to which a conductive treatment has been applied. By polishing the surface of the photosensitive layer 85 with the polishing agent, it is possible to effectively refresh the surface of the photosensitive layer 85. Generally speaking, a polishing agent stagnating at the tip end of a cleaning blade easily aggregates, and the polishing agent in which the particles have grown to have a larger diameter has a tendency to locally shave off a photosensitive drum. In contrast, according to the present embodiment, the photosensitive drum 50 and the cleaning blade 81 reciprocate relative to each other along the rotation axis direction D. With this arrangement, the accumulating substances accumulating at the tip end of the cleaning blade 81 move in the rotation axis direction D. Accordingly, it is possible to prevent the accumulating substances from being distributed unevenly. As a result, it is possible to effectively refresh the surface of the photosensitive layer 85 by using the polishing agent, while preventing the circumferential surface of the photosensitive drum 50 from being abraded unevenly. It should be noted that the present invention is also applicable to toner containing no polishing agent.

In the present embodiment, the external additive of the toner may contain resin beads. Generally speaking, resin beads easily adhere to the circumferential surface of a photosensitive drum firmly. In contrast, according to the present embodiment, the linear pressure (the initial setting value) applied from the cleaning blade 81 in the direction toward the drum center is arranged be equal to or larger than the value selected according to the thrust speed from the range of the lower limit value L expressed in Expression (1) above. With this arrangement, it is difficult for the resin beads to go through the tip end of the cleaning blade 81. In other words, it is difficult for the resin beads to firmly adhere to the circumferential surface of the photosensitive drum 50.

Next, surface roughness of the photosensitive drum 50, a thrust amount of the photosensitive drum 50, a content amount of the filler particles 87, and particle diameters of the filler particles 87 will be explained, with reference to FIGS. 3A to 3D.

The surface roughness of the photosensitive drum 50 is the roughness of the circumferential surface of the photosensitive drum 50, i.e., the roughness of the circumferential surface 84 of the photosensitive layer 85. In the present embodiment, the surface roughness of the photosensitive drum 50 is expressed with a ten point mean roughness value Rz compliant with the Japanese Industrial Standards (JIS) of 1982. When the circumferential surface of the photosensitive drum 50 is flat. i.e., when the surface roughness of the photosensitive drum 50 is 0 μm, it is difficult for the tip end of the cleaning blade 81 to slip on the photosensitive drum 50. Accordingly, it is easy for the adhering substances adhering to the circumferential surface of the photosensitive drum 50 and the accumulating substances accumulating at the tip end of the cleaning blade 81 to go through the tip end of the cleaning blade 81. In contrast, when the surface roughness of the photosensitive drum 50 is too large, the output image may exhibit a defect such as vertical streaks. In order to prevent going through of the adhering substances and the accumulating substances as well as to prevent the occurrence of defects in the output image, it is preferable to arrange the surface roughness of the photosensitive drum 50 to be larger than 0.2 μm and equal to or smaller than 1.5 μm.

The thrust amount of the photosensitive drum 50 is a maximum displacement amount with respect to the rotation axis direction D of the photosensitive drum 50. In the present embodiment, the thrust amount of the photosensitive drum 50 is a movement amount of the photosensitive drum 50 in a one-way part of one reciprocating movement. Accordingly, in the present embodiment, the thrust amount in the going of the reciprocation is equal to the thrust amount in the returning of the reciprocation. When the thrust amount of the photosensitive drum 50 is too small, the effect of preventing the occurrence of uneven abrasion on the circumferential surface of the photosensitive drum 50 may be lowered. On the contrary, when the thrust amount of the photosensitive drum 50 is too large, a color registration error may occur in the image forming apparatus 1 configured to print color images. To avoid these problems, it is preferable to arrange the thrust amount of the photosensitive drum 50 to be in the range from 0.1 mm to 1.5 mm inclusive.

The filler particles 87 contained in the photosensitive layer 85 are realized with silicone filler in the present embodiment. When the content amount of the filler particles 87 is too small, the effect of improving the slippery characteristics between the circumferential surface of the photosensitive drum 50 and the tip end of the cleaning blade 81 may be lowered. On the contrary, when the content amount of the filler particles 87 is too large, the circumferential surface 84 of the photosensitive layer 85 may become too rough, and the cleaning function may be insufficient or the electrical properties of the photosensitive drum 50 may be degraded. Degraded electrical properties of the photosensitive drum 50 means degraded sensitivity of the photosensitive drum 50, which means that the electrical potential does not decrease even when the photosensitive drum 50 is irradiated with light.

The inventors of the present application conducted inventive research on a relationship among the reciprocating movements of the photosensitive drum 50 and the cleaning blade 81 relative to each other, content amounts of the filler particles 87, and the occurrence of dash marks. The inventors discovered that the higher the thrust speed is, the better the occurrence of dash marks is prevented by reducing the content amount of the filler particles 87. More specifically, when the thrust speed is higher than 0 [μm/one turn of the drum] and is equal to or lower than 100 [μm/one turn of the drum], it has been discovered that it is possible to prevent the occurrence of dash marks by arranging the content amount of the filler particles 87 with respect to 100 parts by mass of the binder resin contained in the photosensitive layer 85 to be equal to or smaller than a value selected according to the thrust speed from a range of an upper limit value U2 expressed in Expression (3) shown below:

$$10 \text{ parts by mass} \leq U2 < 50 \text{ parts by mass} \quad (3)$$

Further, the inventors of the present application have discovered that, when the thrust speed is higher than 0 [μm/one turn of the drum] and is equal to or lower than 100 [μm/one turn of the drum], it is possible to prevent the occurrence of dash marks by arranging the content amount of the filler particles 87 with respect to 100 parts by mass of the binder resin contained in the photosensitive layer 85 to be equal to or larger than 3 parts by mass.

In the present embodiment, the content amount of the filler particles 87 is arranged to be equal to or smaller than the value selected according to the thrust speed from the range of the upper limit value U2 expressed in Expression (3) and to be equal to or larger than the 3 parts by mass. With this arrangement, it is possible to prevent the occurrence of dash marks. In other words, it is more difficult for the adhering substances adhering to the circumferential surface of the photosensitive drum 50 and the accumulating substances accumulating at the tip end of the cleaning blade 81 to go through the tip end of the cleaning blade 81.

The particle diameters of the filler particles 87 are represented by a volume median diameter ($D_{50}$) in the present embodiment. When the particle diameters of the filler particles 87 are too small, the effect of improving the slippery characteristics between the circumferential surface of the photosensitive drum 50 and the tip end of the cleaning blade 81 may be lowered. On the contrary, when the particle diameters of the filler particles 87 are too large, the circumferential surface 84 of the photosensitive layer 85 becomes too rough, so that the contact area between the tip end of the cleaning blade 81 and the circumferential surface 84 of the photosensitive layer 85 is reduced too much. As a result, there is a possibility that the cleaning function may become insufficient or that the electrical properties of the photosensitive drum 50 may be degraded. To avoid these situations, it is preferable to arrange the volume median diameter ($D_{50}$) of the filler particles 87 to be in the range from 0.07 μm to 5.0 μm inclusive. To better avoid these situations, it is even more preferable to arrange the volume median diameter ($D_{50}$) of the filler particles 87 to be in the range from 0.1 μm to 1.0 μm inclusive. The volume median diameter ($D_{50}$) of the filler particles 87 may be 0.7 μm, for example. It is possible to measure the volume median diameter ($D_{50}$) of the filler particles 87 by using a particle size distribution measuring apparatus (e.g., "Multisizer" manufactured by Beckman Coulter Inc. or "FPIA (registered trademark) 3000" manufactured by Sysmex Corporation).

As explained above with reference to FIGS. 1, 2, and 3A to 3D, in the present embodiment, the linear pressure applied from the cleaning blade 81 in the direction toward the drum center is arranged to be equal to or larger than the value selected according to the thrust speed from the range of the lower limit value L expressed in Expression (1). With this arrangement, it is more difficult for the adhering substances adhering to the circumferential surface of the photosensitive drum 50 and the accumulating substances accumulating at the tip end of the cleaning blade 81 to go through the tip end of the cleaning blade 81.

Further, in the present embodiment, the linear pressure applied from the cleaning blade 81 in the direction toward the drum center is arranged to be equal to or small than the value selected according to the thrust speed from the range of the upper limit value U1 expressed in Expression (2). With this arrangement, it is possible to extend the life span of the photosensitive drum 50.

Further, in the present embodiment, the content amount of the filler particles 87 is arranged to be equal to or smaller than the value selected according to the thrust speed from the range of the upper limit value U2 expressed in Expression (3). With this arrangement, it is more difficult for the adhering substances adhering to the circumferential surface of the photosensitive drum 50 and the accumulating substances accumulating at the tip end of the cleaning blade 81 to go through the tip end of the cleaning blade 81.

In addition, according to the present embodiment, the contact charging method is used by which the charging bias is applied by the charging roller 51. Generally speaking, contact charging methods have a tendency to develop degradation of the circumferential surface of photosensitive drums. Accordingly, the friction coefficient of the circumferential surface of photosensitive drums would increase, and it would become easier for the adhering substances and the accumulating substances to go through the tip end of the cleaning blade 81. In contrast, according to the present embodiment, it is possible to prevent going through of the adhering substances and the accumulating substances, even though the contact charging method is used. The present invention is applicable not only to roller charging methods, but also to belt charging methods, for example. Further, the present invention is applicable not only to contact charging methods, but also to non-contact charging methods that make use of the proximity discharge phenomenon. For example, it is acceptable to electrically charge the photosensitive drum by arranging a charging roller to be positioned in proximity to the circumferential surface of the photosensitive drum, so as to generate a proximity discharge between the charging roller and the circumferential surface of the photosensitive drum. Further, the present invention is applicable not only to methods by which the photosensitive drum is electrically charged by a proximity discharge, but also to methods by which, for example, the photosensitive drum is electrically charged by a corona discharge (e.g., scorotron methods).

Further, in the present embodiment, the charging bias is a direct-current voltage and does not include an alternating-current voltage. Generally speaking, when the charging bias is a voltage obtained by superimposing an alternating-current voltage onto a direct-current voltage, degradation of the circumferential surface of photosensitive drums develops easily. Accordingly, the friction coefficient of the circumferential surface of photosensitive drums would increase, and it would become easier for the adhering substances and the accumulating substances to go through the tip end of the cleaning blade 81. In contrast, according to the present embodiment, because the charging bias is the direct-current voltage, it is more difficult for the degradation of the circumferential surface of the photosensitive drum to develop, compared to situations where a charging bias obtained by superimposing an alternating-current voltage onto a direct-current voltage is being used. Accordingly, it is possible to prevent going through of the adhering substances and the accumulating substances. Further, the present invention is also applicable to situations where the charging bias is a voltage obtained by superimposing an alternating-current voltage onto a direct-current voltage.

The one embodiment of the present invention has thus been explained with reference to the drawings. It should be noted, however, that the present invention is not limed to the embodiment described above. It is possible to carry out the present invention in various modes without departing from the gist thereof.

For example, as the one embodiment of the present invention, the example of the image forming apparatus 1 is explained in which the photosensitive drum 50 and the cleaning blade 81 are caused to reciprocate relative to each other along the rotation axis direction D of the photosensitive drum 50. However, the present invention is also applicable to an image forming apparatus in which a photosensitive drum and a cleaning blade do not move. When the photosensitive drum and the cleaning blade do not move, the linear pressure (the initial setting value) applied from the cleaning blade in the direction toward the drum center is arranged to be equal to or higher than 15 gf/cm. With this arrangement, it is more difficult for the adhering substances adhering to the circumferential surface of the photosensitive drum and the accumulating substances accumulating at the tip end of the cleaning blade to go through the tip end of the cleaning blade. Further, by arranging the linear pressure (the initial setting value) applied from the cleaning blade in the direction toward the drum center to be equal to or lower than 46 gf/cm, it is possible to extend the life span of the photosensitive drum. Further, the photosensitive layer is arranged to contain filler particles in an amount equal to or smaller than 50 parts by mass with respect to 100 parts by mass of the binder resin contained in the photosensitive layer. With this arrangement, it is more difficult for the adhering substances adhering to the circumferential surface of the photosensitive drum and the accumulating substances accumulating at the tip end of the cleaning blade to go through the tip end of the cleaning blade.

Further, as the one embodiment of the present invention, the example is explained in which the photoconductor is an organic photoconductor; however, the present invention is also applicable to inorganic photoconductors. Even when the photoconductor is an inorganic photoconductor, by arranging the linear pressure applied from the cleaning blade in the direction toward the drum center to be equal to or larger than the value selected according to the thrust speed from the range of the lower limit value L expressed in Expression (1), it is possible to make it difficult for the adhering substances adhering to the circumferential surface of the photosensitive drum and the accumulating substances accumulating at the tip end of the cleaning blade to go through the tip end of the cleaning blade. In contrast, inorganic photoconductors have superior abrasion-resistant characteristics to organic photoconductors. Thus, the cleaning blade shaves off no photoconductor or hardly any photoconductor. Consequently, there is no need to set an upper limit value to the linear pressure applied from the cleaning blade in the direction toward the drum center in consideration of the life span (the shaved-off amount) of the photoconductor. Further, when the photoconductor is an inorganic photoconductor while the photosensitive drum and the cleaning blade are not configured to move, it is possible to prevent going through of the adhering substances and the accumulating substances by arranging the linear pressure (the initial setting value) applied from the cleaning blade in the direction toward the drum center to be equal to or higher than 15 gf/cm.

Further, as the one embodiment of the present invention, the example is explained in which the toner is a low-temperature fusing toner; however, the present invention is also applicable to an image forming apparatus using toner of which the lowest fusing temperature is higher than 160° C.

Further, as the one embodiment of the present invention, the example is explained in which the present invention is applied to a printer; however, the present invention is also applicable to an image forming apparatus (e.g., a multifunction peripheral) other than printers.

EXAMPLES

Next, examples of the present invention will be explained below; however, the present invention is not limited to the examples described below.

In the present examples, an apparatus obtained by modifying TASKalfa 2550Ci (manufactured by KYOCERA Document Solutions Inc.) was used as the image forming apparatus. More specifically, TASKalfa 2550Ci was modified so that the photosensitive drum makes reciprocating movements (thrusts) with respect to the rotation axis direction during image forming processes. Further, TASKalfa 2550Ci was modified so that it is possible to vary the linear pressure (the initial setting value) applied from the cleaning blade in the direction toward the drum center, the thrust amount of the photosensitive drum (the maximum displacement amount of the photosensitive drum), and the thrust speed of the photosensitive drum (the moving distance by which the photosensitive drum moves while the photosensitive drum rotates once (i.e., makes one turn)).

The system speed of the test apparatus (the speed by which transfer paper is conveyed) was 160 mm/second. The photosensitive drum was a positively chargeable single-layer-type OPC drum having a diameter of 30 mm. Polycarbonate resin was used as the binder resin. The specification (the composition) of the photosensitive layer of the photosensitive drum that was used was as follows:

100 parts by mass of polycarbonate resin (the binder resin);

5 parts by mass of a charge generating agent;

50 parts by mass of a positive hole transporting agent;

35 parts by mass of an electron transporting agent; and silicone filler (the filler particles)

As the polycarbonate resin (the binder resin), a resin having a repeating unit expressed by the expression "Resin-7" shown below was used.

<Chemical Formula 1>

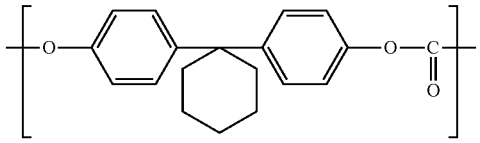

(Resin-7)

As the charge generating agent, X-type metal-free phthalocyanine expressed by the expression "CG-1" shown below was used.

<Chemical Formula 2>

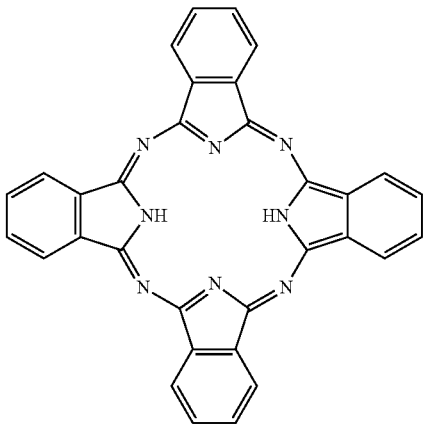

(CG-1)

As the positive hole transporting agent, a compound expressed by the expression "HT-1" shown below was used.

<Chemical Formula 3>

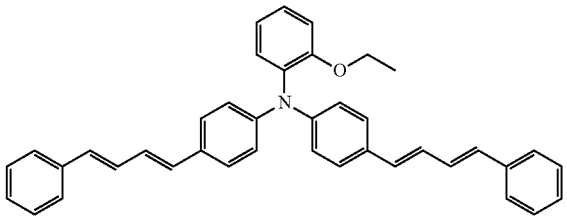

(HT-1)

As the electron transporting agent, a compound expressed by the expression "ET-1" shown below was used.

<Chemical Formula 4>

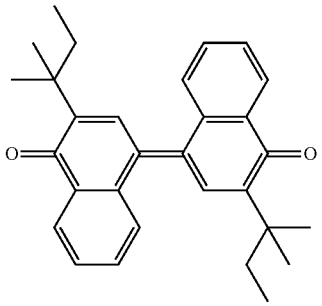

(ET-1)

As the silicone filler, "X-52-854" manufactured by Shin-Etsu Chemical Co. Ltd. (silicone resin; volume mean diameter $D_{50}$: 0.7 μm) was used.

A charging roller made of epichlorohydrin rubber was used. The diameter of the charging roller was 12 mm. The charging bias was a direct-current voltage. The developing unit was a developing unit using a touch-down developing method. The developing roller was positioned so as to be out of contact with the photosensitive drum. A voltage obtained by superimposing an alternating-current voltage onto a direct-current voltage was applied to the developing roller. A cleaning blade made of urethane rubber was used. The thickness of the cleaning blade was 2.0 mm. The hardness of the cleaning blade was 79 degrees on the JIS-A hardness scale, whereas the impact resilience of the cleaning blade was 30%. Toner in which resin beads and titanium oxide were blended as external additives was used as the toner. Sheets of A4-sized paper were used as the transfer paper. Each sheet of transfer paper (A4-sized paper) was conveyed in the transversal direction. In other words, the long edge of each sheet of transfer paper was orthogonal to the conveyance direction of the transfer paper. Printing processes were performed in a low-temperature and low-moisture environment (10° C., 10% RH), while using a text document of which the coverage rate was 5%.

Example 1

In Example 1, 5 parts by mass of silicone filler was added to (contained in) the photosensitive layer of the photosensitive drum.

<Layer Shaved-Off Amounts>

While the thrust amount of the photosensitive drum was set to 100 μm, and the thrust speed thereof was set to 100 [m/one turn of the drum], the pressure contact force [gf/cm] was set to each of the values shown in Table 1 below, so as to measure the shaved-off amount of the photosensitive drum (i.e., the layer shaved-off amount) after printing 200,000 sheets of paper, for each of the pressure contact force values. The results are shown together in Table 1. Tables 1 to 9 indicate, as the pressure contact force values (the initial setting values), the linear pressure applied to a cross-section of the cleaning blade ("blade cross-section") and the linear pressure applied from the cleaning blade in the direction toward the drum center ("drum center").

TABLE 1

| Pressure Contact Force (gf/cm) | | Layer Shaved-off |
|---|---|---|
| Blade Cross-Section | Drum Center | Amount (μm/200K) |
| 22.25 | 20.44 | 10.20 |
| 26.62 | 24.46 | 11.06 |
| 30.43 | 27.95 | 12.36 |

Further, while the thrust amount of the photosensitive drum was set to 340 μm, and the thrust speed thereof was set to 14.78 [μm/one turn of the drum], the pressure contact force [gf/cm] was set to each of the values shown in Table 2 below, so as to measure the shaved-off amount of the photosensitive drum (i.e., the layer shaved-off amount) after printing 200,000 sheets of paper, for each of the pressure contact force values. The results are shown together in Table 2.

TABLE 2

| Pressure Contact Force (gf/cm) | | Layer Shaved-off |
|---|---|---|
| Blade Cross-Section | Drum Center | Amount (μm/200K) |
| 26.51 | 24.12 | 13.84 |
| 30.12 | 27.40 | 14.55 |
| 36.15 | 32.89 | 17.11 |

Further, while the thrust amount of the photosensitive drum was set to 180 μm, and the thrust speed thereof was set to 7.83 [μm/one turn of the drum], the pressure contact force [gf/cm] was set to each of the values shown in Table 3 below, so as to measure the shaved-off amount of the photosensitive drum (i.e., the layer shaved-off amount) after printing 200,000 sheets of paper, for each of the pressure contact force values. The results are shown together in Table 3.

TABLE 3

| Pressure Contact Force (gf/cm) | | Layer Shaved-off |
|---|---|---|
| Blade Cross-Section | Drum Center | Amount (μm/200K) |
| 30.12 | 27.40 | 15.77 |
| 33.74 | 30.69 | 17.12 |
| 36.15 | 32.89 | 18.99 |

Further, while the pressure contact force [gf/cm] was set to each of the values shown in Table 4 below, 200,000 sheets of transfer paper were printed without causing the photosensitive drum to thrust. Further, the shaved-off amount of the photosensitive drum (i.e., the layer shaved-off amount) was measured for each of the pressure contact force values. The results are shown together in Table 4.

TABLE 4

| Pressure Contact Force (gf/cm) | | Layer Shaved-off |
|---|---|---|
| Blade Cross-Section | Drum Center | Amount (μm/200K) |
| 21.54 | 19.60 | 16.00 |
| 26.92 | 24.49 | 18.01 |
| 30.51 | 27.76 | 20.81 |

Figure 4:
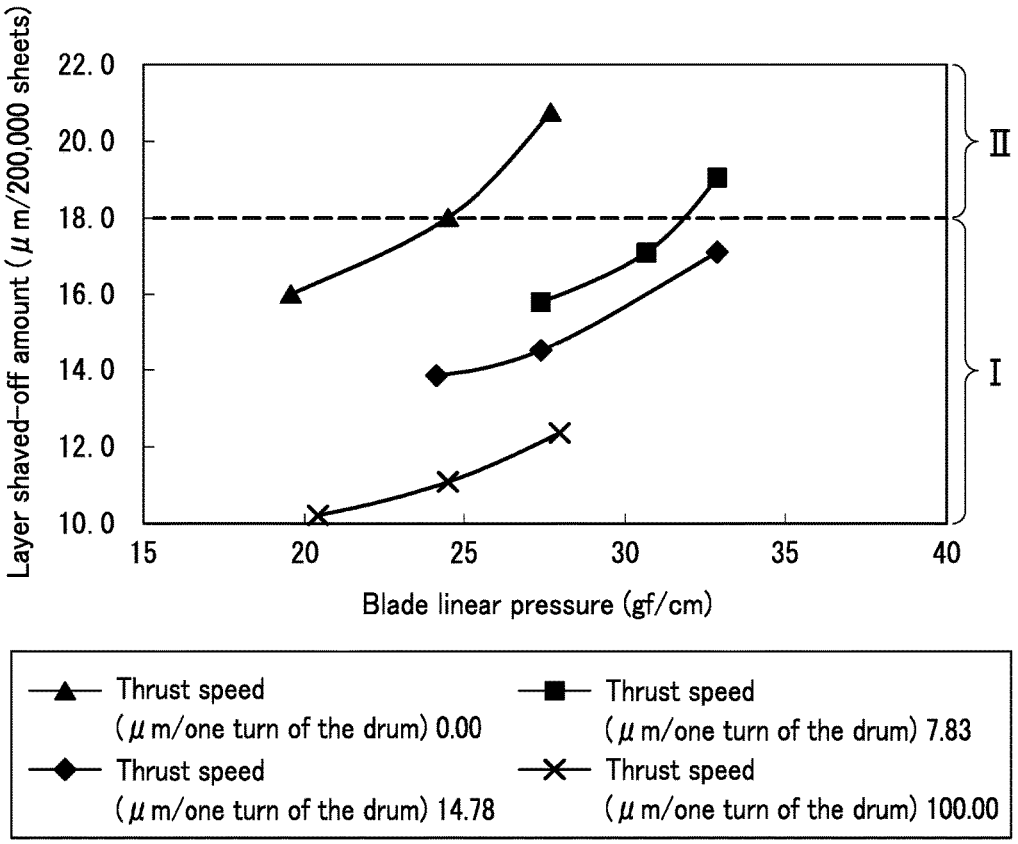
FIG. 4 is a chart illustrating a relationship between blade linear pressure values and layer shaved-off amounts according to the embodiment of the present invention.

FIG. 4 is a chart illustrating a relationship between the levels of linear pressure applied from the cleaning blade in the direction toward the drum center (which hereinafter may be referred to as "blade linear pressure") and the layer shaved-off amounts and plotting the values shown in Tables 1 to 4. The horizontal axis expresses the blade linear pressure [gf/cm], whereas the vertical axis expresses the layer shaved-off amounts [μm/200,000 sheets]. In FIG. 4, Region 1 denotes the region in which the life span of the photosensitive drum measured as the number of printed sheets was 200,000 or more, whereas Region II denotes the region in which the life span of the photosensitive drum measured as the number of printed sheets was equal to or larger than 100,000 but smaller than 200,000. In the present example, the region in which the shaved-off amount observed after printing 200,000 sheets of paper was equal to or smaller than 18 μm was determined as Region I.

By deriving an expression from the chart in FIG. 4, the inventors of the present application calculated a blade linear pressure value [gf/cm] corresponding to a layer shaved-off amount of 18 μm after printing 200,000 sheets, when the thrust amount of the photosensitive drum was set to 100 μm, and the thrust speed thereof was set to 100 [μm/one turn of the drum]. Further, the inventors calculated a blade linear pressure value [gf/cm] corresponding to a layer shaved-off amount of 36 μm after printing 200,000 sheets, as a blade linear pressure value [gf/cm] corresponding to a life span of the photosensitive drum measured as the number of printed sheets being 100,000. As a result, the blade linear pressure value corresponding to the layer shaved-off amount of 18 μm after printing 200,000 sheets was "43.09 gf/cm". Further, the blade linear pressure value corresponding to the layer shaved-off amount of 36 μm after printing 200,000 sheets was "91.41 gf/cm".

Similarly, by deriving an expression from the chart in FIG. 4, the inventors of the present application calculated a blade linear pressure value [gf/cm] corresponding to a layer shaved-off amount of 18 μm after printing 200,000 sheets, as well as a blade linear pressure value [gf/cm] corresponding to a layer shaved-off amount of 36 μm after printing 200,000 sheets, when the thrust amount of the photosensitive drum was set to 340 μm, and the thrust speed thereof was set to 14.78 [μm/one turn of the drum]. As a result, the blade linear pressure value corresponding to the layer shaved-off amount of 18 μm after printing 200,000 sheets was "34.79 gf/cm". Further, the blade linear pressure value corresponding to the layer shaved-off amount of 36 μm after printing 200,000 sheets was "73.30 gf/cm".

Further, by deriving an expression from the chart in FIG. 4, the inventors of the present application calculated a blade linear pressure value [gf/cm] corresponding to a layer shaved-off amount of 18 μm after printing 200,000 sheets, as well as a blade linear pressure value [gf/cm] corresponding to a layer shaved-off amount of 36 μm after printing 200,000 sheets, when the thrust amount of the photosensitive drum was set to 180 μm, and the thrust speed thereof was set to 7.83 [μm-one turn of the drum]. As a result, the blade linear pressure value corresponding to the layer shaved-off amount of 18 μm after printing 200,000 sheets was "32.83 gf/cm". Further, the blade linear pressure value corresponding to the layer shaved-off amount of 36 μm after printing 200,000 sheets was "52.78 gf/cm".

Further, by deriving an expression from the chart in FIG. 4, the inventors of the present application calculated a blade linear pressure value [gf/cm] corresponding to a layer shaved-off amount of 18 μm after printing 200,000 sheets, as well as a blade linear pressure value [gf/cm] corresponding to a layer shaved-off amount of 36 μm after printing 200,000 sheets, when the photosensitive drum was configured not to thrust. As a result, the blade linear pressure value corresponding to the layer shaved-off amount of 18 μm after printing 200,000 sheets was "24.46 gf/cm". Further, the blade linear pressure value corresponding to the layer shaved-off amount of 36 μm after printing 200,000 sheets was "45.53 gf/cm".

Figure 5:
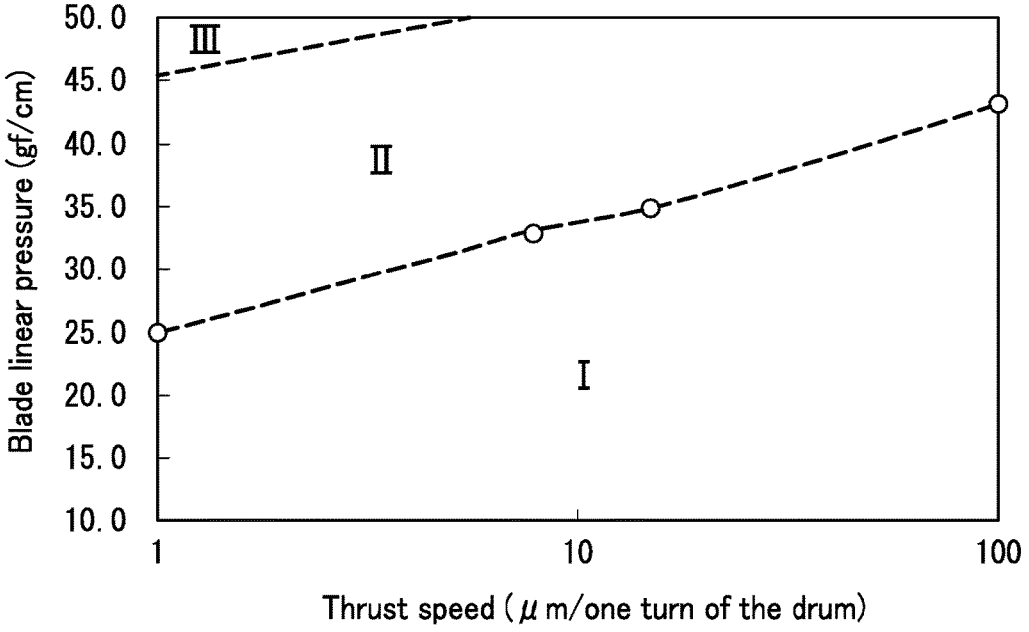
FIG. 5 is a chart illustrating a relationship among thrust speeds, blade linear pressure values, and layer shaved-off amounts, according to the embodiment of the present invention.

A relationship among the thrust speeds, the blade linear pressure values, the layer shaved-off amounts (the life spans of the photosensitive drum) derived from the results presented above is shown in FIG. 5. In FIG. 5, the horizontal axis expresses the thrust speed (μm/one turn of the drum), whereas the vertical axis expresses the blade linear pressure [gf/cm]. The horizontal axis uses a logarithmic scale. Further. Region I denotes the region in which the life span of the photosensitive drum measured as the number of printed sheets was 200,000 or more, whereas Region II denotes the region in which the life span of the photosensitive drum measured as the number of printed sheets was equal to or larger than 100,000 but smaller than 200,000. Region III denotes the region in which the life span of the photosensitive drum measured as the number of printed sheets was smaller than 100,000 (the region in which the layer shaved-off amount after printing 100,000 sheets was larger than 18 μm).

<Dash Mark Appearing Print Counts>

While the thrust amount of the photosensitive drum was set to 100 μm, and the thrust speed thereof was set to 100 [m/one turn of the drum], 200,000 sheets of transfer paper were printed by setting the pressure contact force [gf/cm] to the value shown in Table 5 below, so as to visually check when dash marks started appearing in terms of the number of sheets of transfer paper that have been printed (hereinafter, "dash mark appearing print count"). The results are shown together in Table 5.

TABLE 5

| Pressure Contact Force (gf/cm) | | Dash Mark Appearing Print |
|---|---|---|
| Blade Cross-Section | Drum Center | Count (×1,000) |
| 22.25 | 20.44 | 10 |

While the thrust amount of the photosensitive drum was set to 430 μm, and the thrust speed thereof was set to 18.70 [μm/one turn of the drum], 200,000 sheets of transfer paper were printed by setting the pressure contact force [gf/cm] to each of the values shown in Table 6 below, so as to visually check when dash marks started appearing in terms of the number of sheets of transfer paper that have been printed (a dash mark appearing print count). The results are shown together in Table 6.

TABLE 6

| Pressure Contact Force (gf/cm) | | Dash Mark Appearing Print |
|---|---|---|
| Blade Cross-Section | Drum Center | Count (×1,000) |
| 25.83 | 23.50 | 25 |
| 36.77 | 33.46 | 95 |

While the thrust amount of the photosensitive drum was set to 340 μm, and the thrust speed thereof was set to 14.78 [μm/one turn of the drum], 200,000 sheets of transfer paper were printed by setting the pressure contact force [gf/cm] to each of the values shown in Table 7 below, so as to visually check when dash marks started appearing in terms of the number of sheets of transfer paper that have been printed (a dash mark appearing print count). The results are shown together in Table 7.

TABLE 7

| Pressure Contact Force (gf/cm) | | Dash Mark Appearing Print |
|---|---|---|
| Blade Cross-Section | Drum Center | Count (×1,000) |
| 25.83 | 23.50 | 40 |
| 30.12 | 27.40 | 60 |
| 36.15 | 32.89 | 130 |

While the thrust amount of the photosensitive drum was set to 180 μm, and the thrust speed thereof was set to 7.83 [μm/one turn of the drum], 200,000 sheets of transfer paper were printed by setting the pressure contact force [gf/cm] to each of the values shown in Table 8 below, so as to visually check when dash marks started appearing in terms of the number of sheets of transfer paper that have been printed (a dash mark appearing print count). The results are shown together in Table 8.

TABLE 8

| Pressure Contact Force (gf/cm) | | Dash Mark Appearing Print |
|---|---|---|
| Blade Cross-Section | Drum Center | Count (×1,000) |
| 30.12 | 27.40 | 105 |
| 33.74 | 30.69 | 145 |
| 36.15 | 32.89 | 170 |

Further, while the photosensitive drum was configured not to thrust, 200,000 sheets of transfer paper were printed by setting the pressure contact force [gf/cm] to the value shown in Table 9 below, so as to visually check when dash marks started appearing in terms of the number of sheets of transfer paper that have been printed (a dash mark appearing print count). The results are shown together in Table 9.

TABLE 9

| Pressure Contact Force (gf/cm) | | Dash Mark Appearing Print |
|---|---|---|
| Blade Cross-Section | Drum Center | Count (×1,000) |
| 21.54 | 19.60 | 80 |

Figure 6:
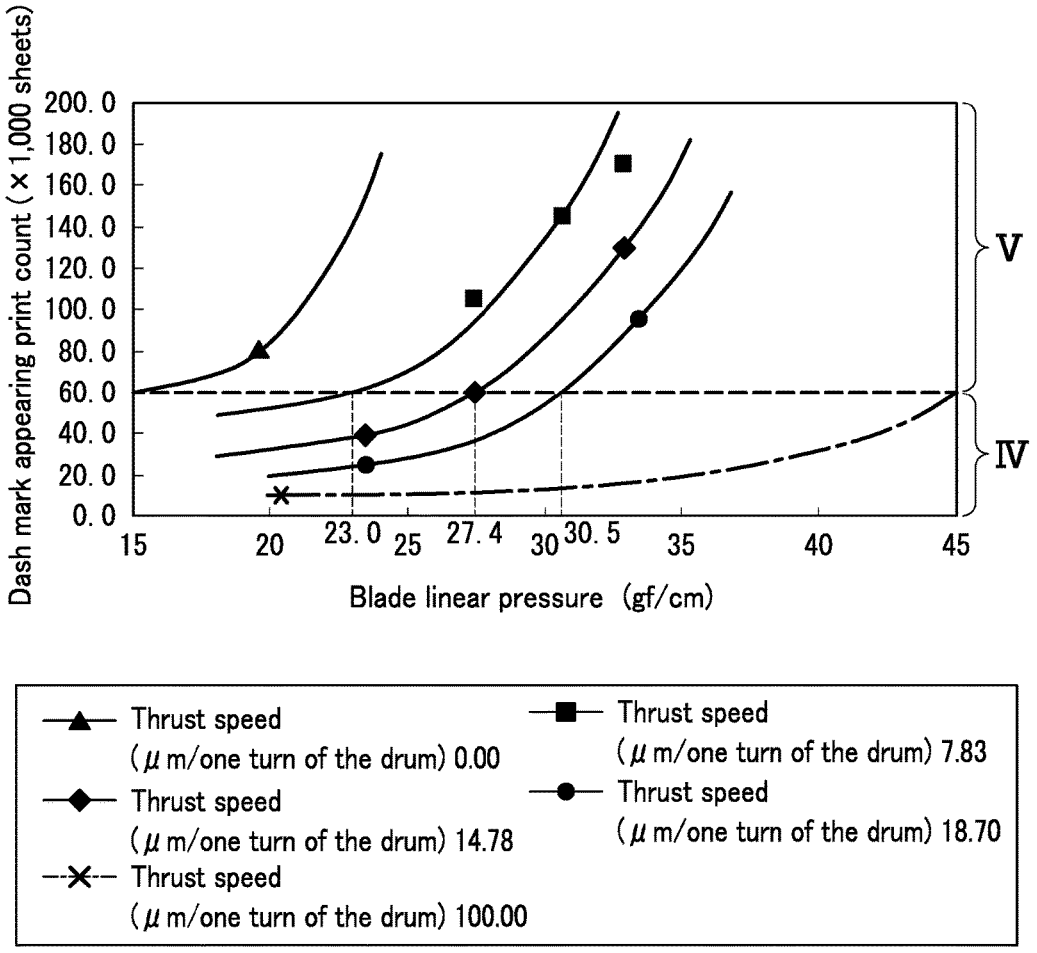
FIG. 6 is a chart illustrating a relationship between blade linear pressure values and dash mark appearing print counts according to the embodiment of the present invention.

FIG. 6 is a chart illustrating a relationship between the blade linear pressure values and the dash mark appearing print counts and plotting the values shown in Tables 5 to 9. The horizontal axis expresses the blade linear pressure [gf/cm], whereas the vertical axis expresses the dash mark appearing print counts (×1,000 sheets). In FIG. 6, region IV denotes the region in which the dash mark appearing print count was 60,000 or smaller, whereas Region V denotes the region in which the dash mark appearing print count was over 60,000.

By deriving a formula from the chart in FIG. 6, the inventors of the present application calculated a blade linear pressure value [gf/cm] corresponding to a dash mark appearing print count of 60,000, when the thrust amount of the photosensitive drum was set to 100 μm, and the thrust speed thereof was set to 100 [μm/one turn of the drum]. As a result, the blade linear pressure value corresponding to the dash mark appearing print count of 60,000 was "45.00 gf/cm".

Similarly, by deriving a formula from the chart in FIG. 6, the inventors of the present application calculated a blade linear pressure value [gf/cm] corresponding to a dash mark appearing print count of 60,000, when the thrust amount of the photosensitive drum was set to 430 μm, and the thrust speed thereof was set to 18.70 [μm/one turn of the drum]. As a result, the blade linear pressure value corresponding to the dash mark appearing print count of 60,000 was "30.50 gf/cm".

Further, by deriving a formula from the chart in FIG. 6, the inventors of the present application calculated a blade linear pressure value [gf/cm] corresponding to a dash mark appearing print count of 60,000, when the thrust amount of the photosensitive drum was set to 340 μm, and the thrust speed thereof was set to 14.78 [μm/one turn of the drum]. As a result, the blade linear pressure value corresponding to the dash mark appearing print count of 60,000 was "27.40 gf/cm".

Further, by deriving a formula from the chart in FIG. 6, the inventors of the present application calculated a blade linear pressure value [gf/cm] corresponding to a dash mark appearing print count of 60,000, when the thrust amount of the photosensitive drum was set to 180 μm, and the thrust speed thereof was set to 7.83 [μm/one turn of the drum]. As a result, the blade linear pressure value corresponding to the dash mark appearing print count of 60,000 was "23.00 gf/cm".

Further, by deriving a formula from the chart in FIG. 6, the inventors of the present application calculated a blade linear pressure value [gf/cm] corresponding to a dash mark appearing print count of 60,000, when the photosensitive drum was configured not to thrust. As a result, the blade linear pressure value corresponding to the dash mark appearing print count of 60,000 was "15.00 gf/cm".

Figure 7:
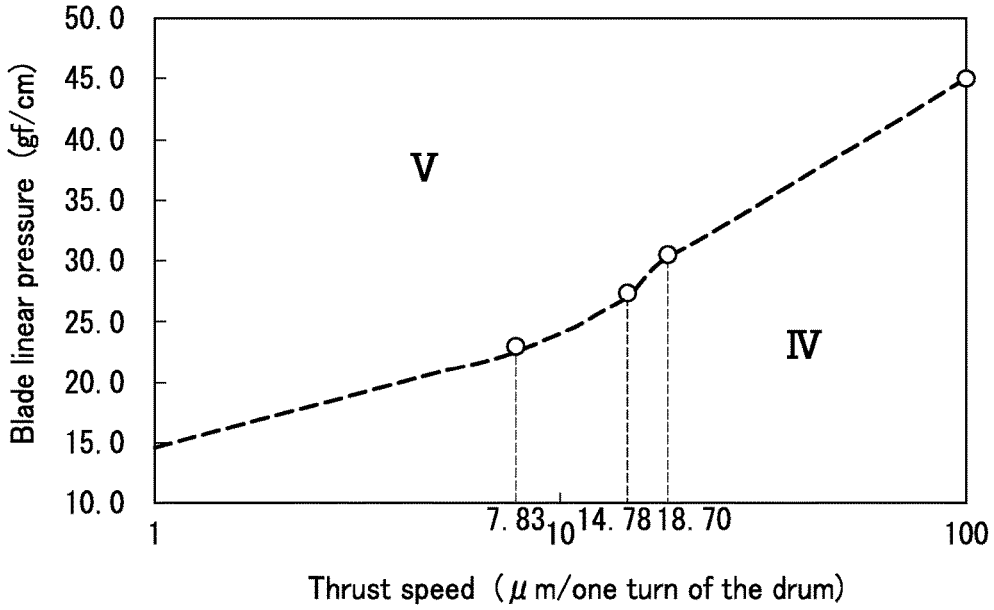
FIG. 7 is a chart illustrating a relationship among thrust speeds, blade linear pressure values, and dash mark appearing print counts, according to the embodiment of the present invention.

A relationship among the thrust speeds, the blade linear pressure values, and the dash mark appearing print counts derived from the results presented above is shown in FIG. 7. In FIG. 7, the horizontal axis expresses the thrust speed [μm/one turn of the drum], whereas the vertical axis expresses the blade linear pressure [gf/cm]. The horizontal axis uses a logarithmic scale. Further, Region IV denotes the region in which the dash mark appearing print count was 60,000 or smaller, whereas Region V denotes the region in which the dash mark appearing print count was over 60,000.

<A Relationship Among the Thrust Speeds, the Blade Linear Pressure Values, the Layer Shaved-Off Amounts, and the Dash Mark Appearing Print Counts>

Figure 8:
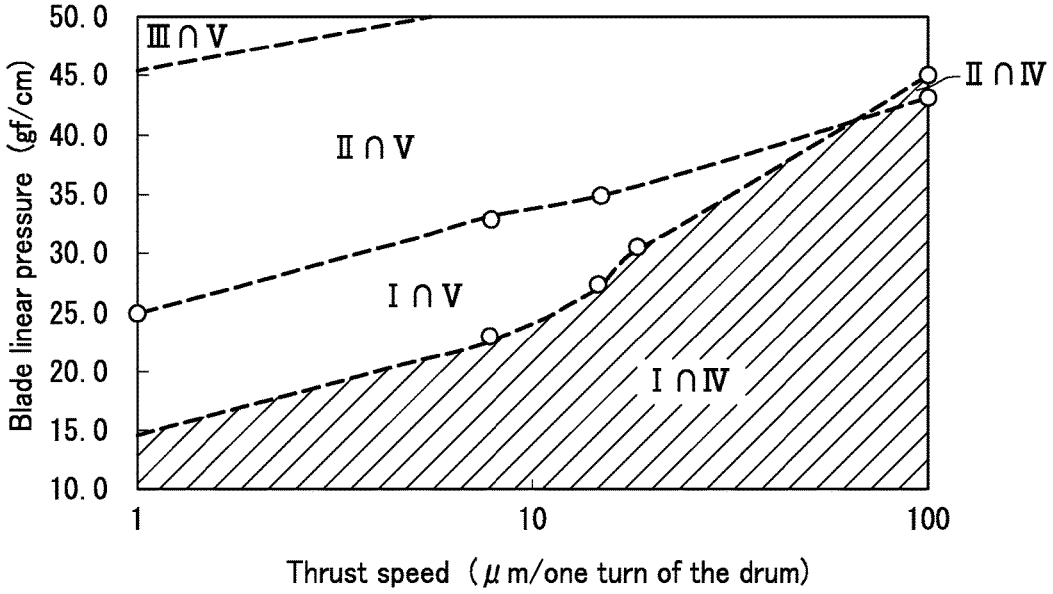
FIG. 8 is a chart illustrating a relationship among thrust speeds, blade linear pressure values, layer shaved-off amounts, and dash mark appearing print counts, according to the embodiment of the present invention.
Figure 9:
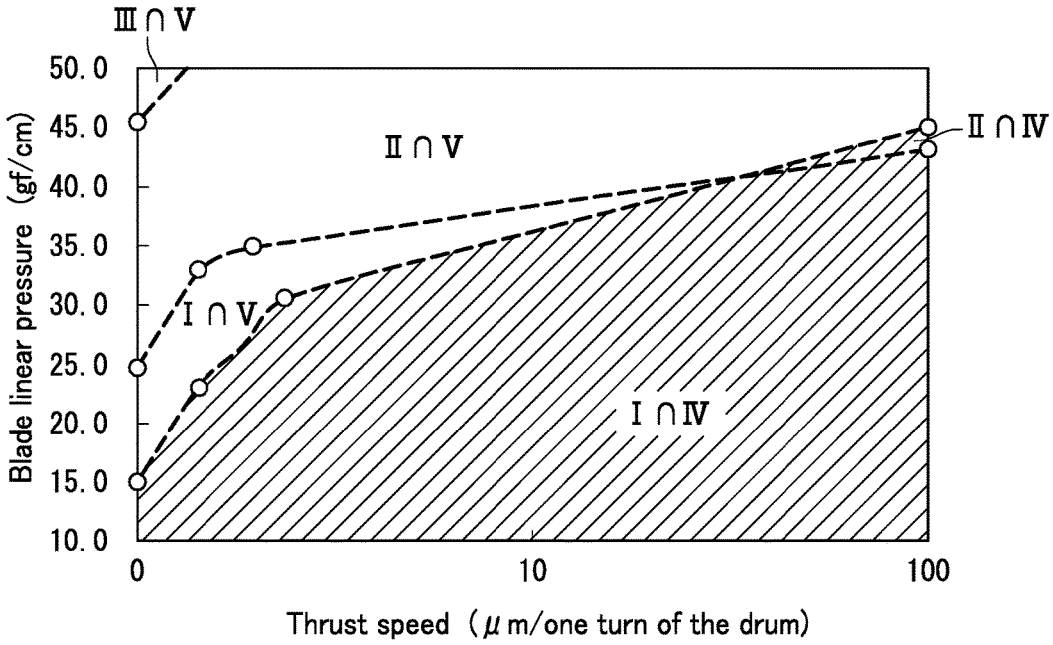
FIG. 9 is another chart illustrating the relationship among the thrust speeds, the blade linear pressure values, the layer shaved-off amounts, and the dash mark appearing print counts, according to the embodiment of the present invention.

FIG. 8 is a chart obtaining by superimposing FIG. 5 on FIG. 7. In FIG. 8, the horizontal axis expresses the thrust speed [μm/one turn of the drum], whereas the vertical axis expresses the blade linear pressure [gf/cm]. The horizontal axis uses a logarithmic scale. FIG. 9 is a chart obtained by inverting the relationship between the thrust speeds and the blade linear pressure values illustrated in FIG. 8. In FIG. 9 the horizontal axis expresses the thrust speed [μm/one turn of the drum], whereas the vertical axis expresses the blade linear pressure [gf/cm]. In FIGS. 8 and 9, the region indicated with hatching (the region "I∩IV" and the region "II∩IV") denotes the region in which the dash mark appearing print count was 60,000 or smaller. The region I∩V denotes the region in which the life span of the photosensitive drum measured as the number of printed sheets was equal to or larger than 200,000 while the dash mark appearing print count was over 60,000. The region II∩V denotes the region in which the life span of the photosensitive drum measured as the number of printed sheets was equal to or larger than 100,000 but smaller than 200,000, while the dash mark appearing print count was over 60,000.

Example 2

Example 2 is different from Example 1 in that six types of photosensitive drums having mutually-different silicone filler added amounts (filler added amounts) were used. More specifically, the photosensitive drums in which 3 parts by mass, 10 parts by mass, 20 parts by mass, 30 parts by mass, 40 parts by mass, and 50 parts by mass of silicone filler was added to 100 parts by mass of binder resin (polycarbonate resin) were used.

Table 10 shown below indicates results (cleanability) obtained by setting the thrust amount of the photosensitive drum to 100 μm, setting the thrust speed thereof to 100 [μm/one turn of the drum], setting the blade linear pressure to 20 gf/cm, and printing 100,000 sheets of transfer paper by using each of the photosensitive drums having the mutually-different filler added amounts, so as to visually check to see whether or not there were one or more unclean spots on the circumferential surface of the photosensitive drums and the sheets of transfer paper (the output images). More specifically, it was checked to see whether or not one or more unclean spots were made on the circumferential surface of the photosensitive drum by toner or external additives that passed by the cleaning blade. Also, it was checked to see whether or not one or more unclean spots were made on the sheets of transfer paper by toner that passed by the cleaning blade. In Tables 10 to 13, "A" indicates that no unclean spots were made on the circumferential surface of the photosensitive drum and the sheets of transfer paper (the output images). In other words, neither the toner nor the external additives passed by the cleaning blade. Further, "B" indicates that, although no toner passed by the cleaning blade, the external additives pass by the cleaning blade and caused the circumferential surface of the photosensitive drum to look significantly white. Further, "C" indicates that the toner passed by the cleaning blade, adhered to the circumferential surface of the photosensitive drum, and made toner-derived unclean spots on the circumferential surface of the photosensitive drum and the sheets of transfer paper (the output images).

TABLE 10

| Filler Added Amount | Cleanability |
|---|---|
| 3 | A |
| 10 | B |
| 20 | C |
| 30 | C |
| 40 | C |
| 50 | C |

Table 11 shown below indicates results (cleanability) obtained by setting the thrust amount of the photosensitive drum to 250 μm, setting the thrust speed thereof to 17.86 [μm/one turn of the drum], setting the blade linear pressure to 20 gf/cm, and printing 100,000 sheets of transfer paper by using each of the photosensitive drums having the mutually-different filler added amounts, so as to visually check to see whether or not there were one or more unclean spots on the circumferential surface of the photosensitive drums and the sheets of transfer paper (the output images).

TABLE 11

| Filler Added Amount | Cleanability |
|---|---|
| 3 | A |
| 10 | A |
| 20 | B |
| 30 | B |
| 40 | C |
| 50 | C |

Table 12 shown below indicates results (cleanability) obtained by setting the thrust amount of the photosensitive drum to 250 μm, setting the thrust speed thereof to 3.52 [μm/one turn of the drum], setting the blade linear pressure to 20 gf/cm, and printing 100,000 sheets of transfer paper by using each of the photosensitive drums having the mutually-different filler added amounts, so as to visually check to see whether or not there were one or more unclean spots on the circumferential surface of the photosensitive drums and the sheets of transfer paper (the output images).

TABLE 12

| Filler Added Amount | Cleanability |
|---|---|
| 3 | A |
| 10 | A |
| 20 | A |
| 30 | B |
| 40 | B |
| 50 | C |

Table 13 shown below indicates results (cleanability) obtained by setting the blade linear pressure to 20 gf/cm, and printing 100,000 sheets of transfer paper by using each of the photosensitive drums having the mutually-different filler added amounts while the photosensitive drums were configured not to thrust, so as to visually check to see whether or not there were one or more unclean spots on the circumferential surface of the photosensitive drums and the sheets of transfer paper (the output images).

TABLE 13

| Filler Added Amount | Cleanability |
|---|---|
| 3 | A |
| 10 | A |
| 20 | A |
| 30 | A |
| 40 | B |
| 50 | B |

Figure 10:
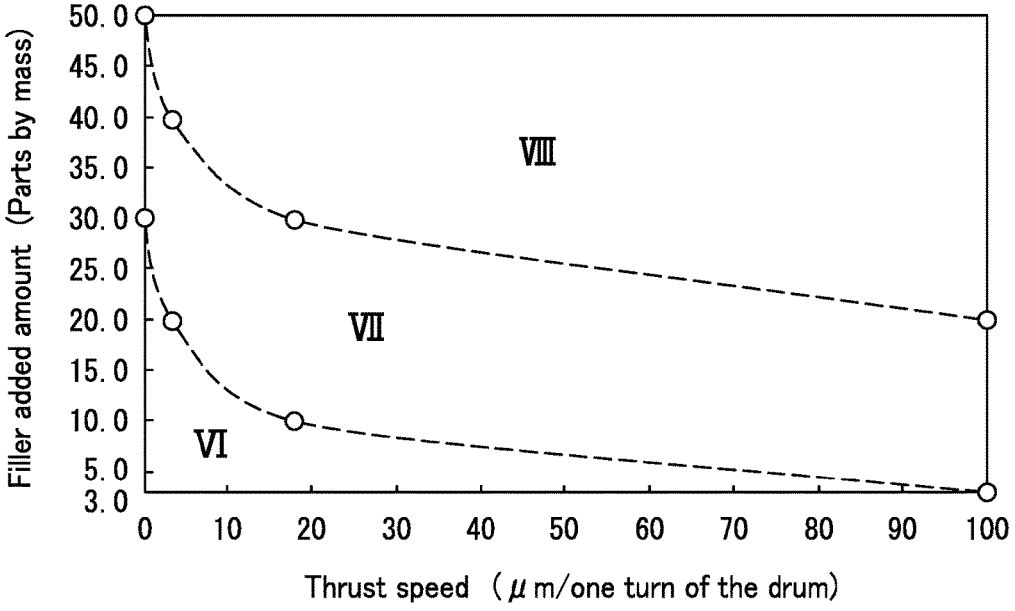
FIG. 10 is a chart illustrating a relationship among thrust speeds, filler added amounts, and cleanability levels, according to the embodiment of the present invention.
Figure 11:
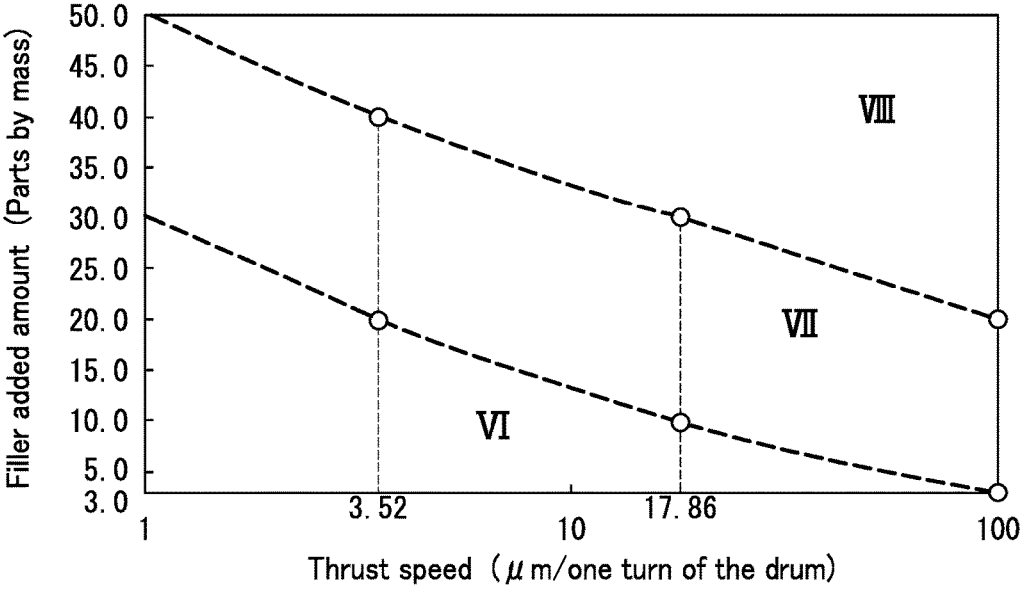
FIG. 11 is another chart illustrating the relationship among the thrust speeds, the filler added amounts, and the cleanability levels, according to the embodiment of the present invention.

FIGS. 10 and 11 each present a chart illustrating a relationship among the thrust speeds, the filler added amounts, and the cleanability levels and plotting the values shown in Tables 10 to 13. In FIGS. 10 and 11, the horizontal axis expresses the thrust speed [μm/one turn of the drum], whereas the vertical axis expresses the filler added amounts [parts by mass]. The horizontal axis in FIG. 11 uses a logarithmic scale.

In FIGS. 10 and 11, Region VI denotes the region in which the cleanability level was "A", while Region VII denotes the region in which the cleanability level was "B", and Region VIII denotes the region in which the cleanability level was "C".

INDUSTRIAL APPLICABILITY

The present invention is applicable to the field of image forming apparatuses configured to form an image on a sheet.

The invention claimed is:

1. An image forming apparatus comprising:

an image bearing member including a single-layer-type photosensitive layer containing a binder resin and filler particles, the filler particles being contained in an amount in a range from 3 parts by mass to 40 parts by mass inclusive with respect to 100 parts by mass of the binder resin;

a charging section that is either in contact with or positioned close to the image bearing member and that electrically charges the image bearing member by generating a proximity discharge between the charging section and the image bearing member;

a developing section that supplies toner to a circumferential surface of the charged image bearing member;

a cleaning member that is brought into pressure contact with the circumferential surface of the image bearing member being rotated, by applying linear pressure equal to or higher than 15 gf/cm; and a driving mechanism that causes the image bearing member and the cleaning member to reciprocate relative to each other along a rotation axis direction of the image bearing member, wherein the cleaning member has a degree of hardness equal to or higher than 65° and a degree of impact resilience equal to or lower than 30%, a volume median diameter of the filler particles is in a range from 0.07 μm to 5.0 μm inclusive, surface roughness of the image bearing member is larger than 0.2 μm and is equal to or smaller than 1.5 μm, a moving distance by which the image bearing member and the cleaning member move relative to each other while the image bearing member rotates once is longer than 0 μm and is equal to or shorter than 100 μm, the cleaning member is brought into pressure contact with the circumferential surface of the image bearing member being rotated, by applying linear pressure equal to or larger than a value selected according to the moving distance, and the driving mechanism causes the image bearing member to reciprocate.

2. The image forming apparatus according to claim 1, wherein the cleaning member is brought into pressure contact with the circumferential surface of the image bearing member being rotated, by applying linear pressure in a range from 15 gf/cm to 46 gf/cm inclusive.

3. The image forming apparatus according to claim 1, wherein the toner includes a plurality of toner particles, each of the plurality of toner particles has a toner base particle and an external additive adhering to a surface of the toner base particle, and the external additive includes a polishing agent.

4. The image forming apparatus according to claim 3, wherein the external additive further includes resin beads.

5. The image forming apparatus according to claim 1, comprising a developer, wherein the developer includes the toner.

6. The image forming apparatus according to claim 1, wherein the photosensitive layer includes a positively-chargeable single-layer-type organic photoconductor.

7. The image forming apparatus according to claim 1, wherein a lowest fusing temperature of the toner is 160° C. or lower.

8. The image forming apparatus according to claim 1, wherein a friction coefficient of the filler particles is smaller than a friction coefficient of the binder resin, and a degree of hardness of the filler particles is higher than a degree of hardness of the binder resin.

9. The image forming apparatus according to claim 1, wherein a maximum displacement amount of the image bearing member with respect to the rotation axis direction is in a range from 0.1 mm to 1.5 mm inclusive.

* * * * *